US009140151B2

(12) United States Patent
Matsumochi et al.

(10) Patent No.: US 9,140,151 B2
(45) Date of Patent: Sep. 22, 2015

(54) VALVE GEAR

(71) Applicant: HONDA MOTOR CO., LTD., Tokyo (JP)

(72) Inventors: Yuji Matsumochi, Saitama (JP); Kaori Kobayashi, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/368,951

(22) PCT Filed: Dec. 18, 2012

(86) PCT No.: PCT/JP2012/082761
§ 371 (c)(1),
(2) Date: Jun. 26, 2014

(87) PCT Pub. No.: WO2013/099695
PCT Pub. Date: Jul. 4, 2013

(65) Prior Publication Data

US 2015/0007789 A1 Jan. 8, 2015

(30) Foreign Application Priority Data

Dec. 27, 2011 (JP) ..... 2011-285797

(51) Int. Cl.
*F01L 1/34* (2006.01)
*F01L 13/00* (2006.01)
(Continued)

(52) U.S. Cl.
CPC ..... *F01L 13/0047* (2013.01); *F01L 1/047* (2013.01); *F01L 1/34* (2013.01); *F01L 1/3442* (2013.01);
(Continued)

(58) Field of Classification Search
CPC ..... F01L 1/0047; F01L 1/34; F01L 1/3443; F01L 13/0047; F01L 2001/34466; F01L 2001/34489
USPC ..... 123/90.16, 90.17, 90.6
See application file for complete search history.

(56) References Cited

U.S. PATENT DOCUMENTS 7,513,232 B2 * 4/2009 Schneider ..... 123/90.17
8,695,545 B2 4/2014 Tateno
(Continued)

FOREIGN PATENT DOCUMENTS

JP 2002-054410 A 2/2002
JP 2006-105062 A 4/2006
(Continued)

OTHER PUBLICATIONS

Japanese Office Action dated Mar. 24, 2015, issued in corresponding JP Patent Application No. 2013-551629 (3 pages) which cites WO2012/132002 already submitted on Sep. 4, 2014.
(Continued)

*Primary Examiner* — Ching Chang
(74) *Attorney, Agent, or Firm* — Westerman, Hattori, Daniels & Adrian, LLP

(57) ABSTRACT

Provided is a valve gear which achieves a reduced size and is capable of changing the valve opening timing of an engine valve and changing the length of the valve opening period thereof. A valve gear is provided with: a rotatable first camshaft; a first cam piece that is relatively unrotatably provided on the first camshaft; a second camshaft that is included in the first camshaft and coaxially rotatable; a second cam piece that is relatively unrotatably provided on the second camshaft; a housing; a first vane rotor that is relatively rotatable with respect to the housing; and a second vane rotor that is relatively rotatable with respect to the housing and the first vane rotor The first vane rotor is relatively unrotatably coupled to the second camshaft, and the second vane rotor is relatively rotatably coupled to the first camshaft.

8 Claims, 15 Drawing Sheets

(51) Int. Cl.
*F01L 1/047* (2006.01)
*F01L 1/344* (2006.01)

(52) U.S. Cl.
CPC .. *F01L 2001/0473* (2013.01); *F01L 2001/3445* (2013.01); *F01L 2001/34459* (2013.01); *F01L 2001/34466* (2013.01); *F01L 2001/34489* (2013.01); *F01L 2013/0084* (2013.01)

(56) References Cited

U.S. PATENT DOCUMENTS

| | | | |
|---|---|---|---|
| 2007/0240657 | A1 | 10/2007 | Schneider |
| 2012/0279464 | A1 | 11/2012 | Tateno |

FOREIGN PATENT DOCUMENTS

| | | | |
|---|---|---|---|
| JP | 2008-528871 | A | 7/2008 |
| JP | 2009-144522 | A | 7/2009 |
| WO | 2012/132002 | A1 | 10/2012 |

OTHER PUBLICATIONS

International Search Report (ISR) of PCT/JP2012/082761 dated Jan. 22, 2013.

Japanese Office Action dated Mar. 24, 2015, issued in corresponding JP Patent Application No. 2013-551629 with English translation (6 pages).

* cited by examiner

VALVE GEAR

TECHNICAL FIELD

The present invention relates to a valve gear for driving engine valves of an internal combustion engine.

BACKGROUND ART

It is desirable that a valve gear of an internal combustion engine has a function to change the valve opening timing of an engine valve and change the length of the valve open period of the engine valve to improve the combustion efficiency. In response to such a demand, Patent Document 1 discloses a technology for changing the length of the valve open period of an engine valve by changing one phase of double camshafts by phase changing means provided at the end portion of the camshaft. Further, Patent Document 2 discloses a technology for shifting the valve opening timing of an engine valve and changing the valve open period of the engine valve by changing the both phases of double camshafts by phase control mechanisms provided at the both ends of the camshafts.

BACKGROUND ART DOCUMENT

Patent Documents

Patent Document 1: Japanese Patent Application Publication Laid-Open No. 2002-054410
Patent Document 2: Japanese Patent Application Publication Laid-Open No. 2009-144522

DISCLOSURE OF THE INVENTION

Problems to be Solved by the Invention

However, the technology disclosed by Patent Document 1 has a problem of a complicated structure for arranging phase control mechanisms at the both end portions of camshafts and a large size of a device because it is necessary to form oil passages corresponding to the respective phase control mechanisms.

The present invention has been developed in this situation, and an object of the invention is to provide a valve gear that allows downsizing and enables changing the valve opening timing of an engine valve and changing the length of the valve open period.

Means for Solving the Problems

To solve the problem, the present invention provides a valve gear driving an engine valve of an internal combustion engine, comprising:

a first camshaft rotatable around a rotation axis;

a first cam piece driving the engine valve, the first cam piece being prohibited to rotate relative to the first camshaft;

a second camshaft disposed inside the first camshaft, the second camshaft being rotatable around the rotation axis;

a second cam piece driving the engine valve, the second cam piece being prohibited to rotate relative to the second camshaft;

a housing;

a first vane rotor housed in the housing, the first vane rotor being rotatable relative to the housing; and a second vane rotor housed in the housing, the second vane rotor being rotatable relative to the housing and the first vane rotor, wherein the first vane rotor is connected to one of the first camshaft and the second camshaft, being prohibited to rotate relative to the one, and wherein the second vane rotor is connected to the other one of the first camshaft and the second camshaft, being rotatable relative to the other one.

By this arrangement, as the first vane rotor and the second vane rotor housed in one housing function as phase control means, downsizing is possible, and it is possible to change the valve opening timing of the engine valve and change the length of the valve open period.

The valve gear preferably further comprises:

a first connecting member capable of switching between a permission state and a prohibition state, wherein relative rotation between the first vane rotor and the second vane rotor or relative rotation between the housing and one of the first vane rotor and the second vane rotor is permitted in the permission state; and prohibited in the prohibition state a second connecting member capable of switching between a permission state and a prohibition state, wherein relative rotation between the housing and the other one of the first vane rotor and the second vane rotor is permitted in the permission state and prohibited in the prohibition state.

By this arrangement, it is possible, for example, to rotate only one of the first vane rotor and the second vane rotor, or rotate the first vane rotor and the second vane rotor independently from each other.

The first vane rotor and the second vane rotor may be lined up along the rotation axis direction.

By this arrangement, it is possible to change the phases of the first vane rotor and the first connecting member second vane rotor by a large amount.

The valve gear preferably further comprises:

a first connecting member capable of switching between a permission state and a prohibition state, wherein relative rotation between the first vane rotor and the second vane rotor is permitted in the permission state and prohibited in the prohibition state; and a second connecting member capable of switching between a permission state and a prohibition state, wherein relative rotation between the housing and the second vane rotor is permitted in the permission state and prohibited in the prohibition state.

Further, the first connecting member preferably includes:

a first spring housed in the first vane rotor; and a first pin housed in the first vane rotor and capable of entering the second connecting member by an urging force of the first spring, and wherein the second connecting member includes:

a second spring housed in the second vane rotor; and a second pin housed in the second vane rotor and capable of entering the housing by an urging force of the second spring.

The second vane rotor may be arranged on a radially inner side of the first vane rotor.

By this arrangement, it is possible to make the first vane rotor and the second vane rotor have respective pressure receiving sufficient area and thereby rotate the first vane rotor and the second vane rotor respectively alone The valve gear preferably further comprises:

a first connecting member capable of switching between a permission state and a prohibition state, wherein relative rotation between the first vane rotor and the housing is permitted in the permission state and prohibited in the prohibition state; and a second connecting member capable of switching between a permission state and a prohibition state, wherein relative rotation between the housing and the other second vane rotor is permitted in the permission state and prohibited in the prohibition state.

The first connecting member preferably includes:

a first spring housed in the first vane rotor; and a first pin housed in the first vane rotor and capable of entering the housing by an urging force of the first spring, and wherein the second connecting member includes:

a second spring housed in the second vane rotor; and a second pin housed in the second vane rotor and capable of entering the housing by an urging force of the second spring.

Advantage of the Invention

According to the present invention, it is possible to provide a valve gear that allows downsizing and enables changing the valve opening timing of an engine valve and changing length of the valve open period.

EMBODIMENTS FOR CARRYING OUT THE INVENTION

Figure 1:
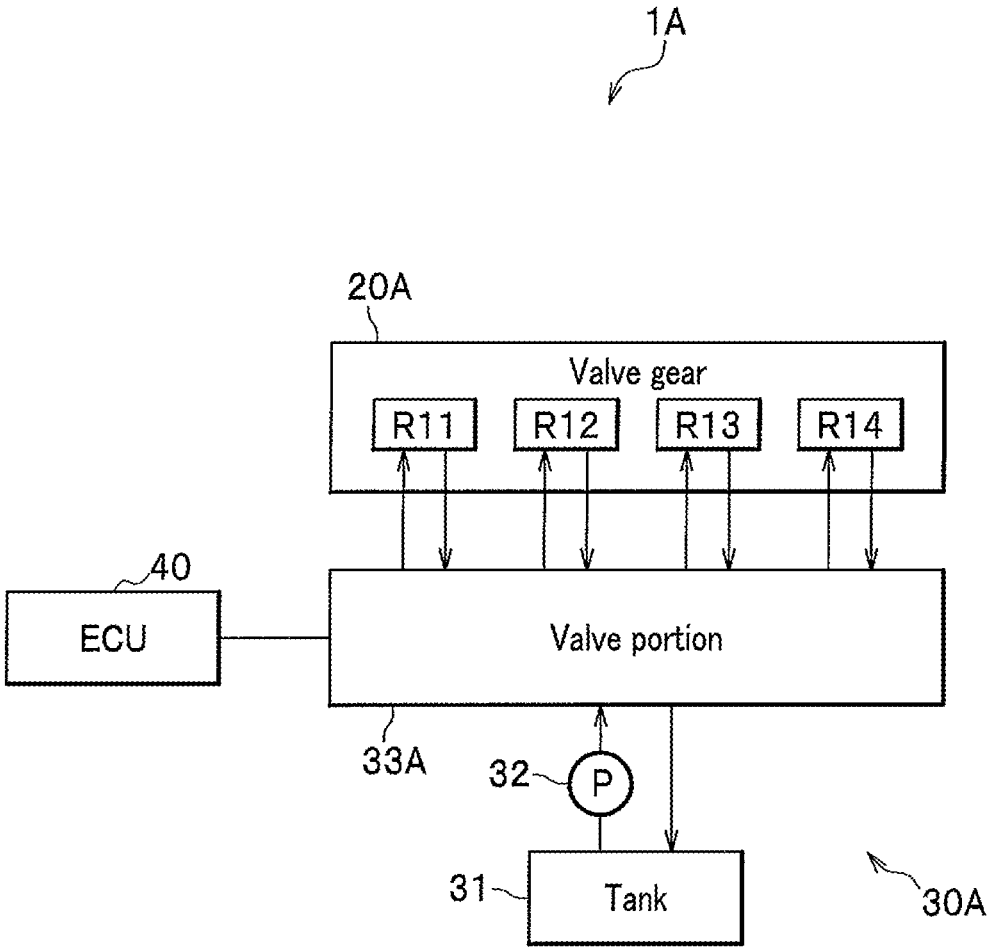
FIG. 1 is a schematic diagram showing a valve system in a first embodiment according to the present invention.

Embodiments of the present invention will be described below, referring to the drawings, as appropriate. The same symbol will be assigned to common elements to respective drawings, and overlapping description will be omitted.

First Embodiment

As shown in FIG. 1, a valve system 1A in a first embodiment of the invention includes a valve gear 20A that opens and closes an intake valve 210 and an exhaust valve 211, the valves being engine valves of an internal combustion engine 10 (see FIG. 2), and can change the opening and closing timings, a hydraulic pressure supply device 30A for driving the valve gear 20A by supplying hydraulic pressure, and an ECU (Electronic Control Unit) 40 for electronic control of the system.

Hydraulic Pressure Supply Device

As shown in FIG. 1, the hydraulic pressure supply device 30A supplies hydraulic pressure to oil passages R11-R14 to drive a first vane rotor 26A, a second vane rotor 27A, a first connecting member 28A, and a second connecting member 29A (see FIG. 3) of the valve gear 20A. The hydraulic pressure supply device 30A includes a tank (oil pan) 31 for reserving oil, a pump 32 provided downstream of the tank 31 to generate hydraulic pressure in an oil circulation passage, and a valve portion 33A provided between the pump 32 and the oil passages R11-R14 to be able to switch between supplying and not supplying oil to the oil passages R11-R14. The tank 31, the pump 32, the valve portion 33A, and the oil passages R11-R14 structure the oil circulation passage. All of the most delayed angle control at the time when the internal combustion engine 10 is stopped, advance angle control after startup of the internal combustion engine 10, delay angle control, open angle control after the most advance angle control, and the like, which will be described later, are performed by that the ECU 40 controls driving of the valve portion 33A.

Internal Combustion Engine

Figure 2:
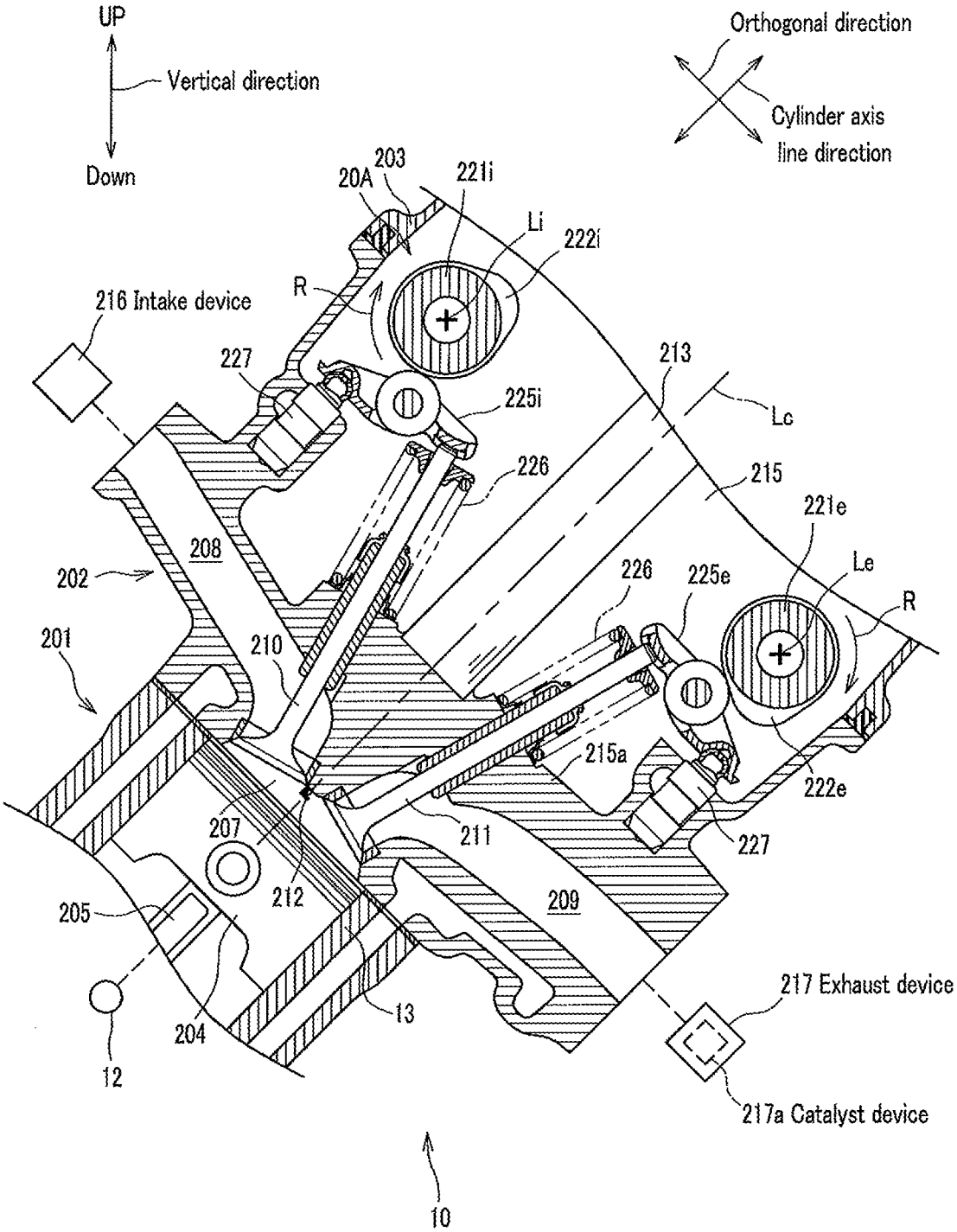
FIG. 2 is a cross-sectional view showing the inner structure of an internal combustion engine.

As shown in FIG. 2, in the present embodiment, the internal combustion engine 10 is a reciprocating engine configured as an in-line four cylinder engine with four cylinders 13 in a cylinder block 201. However, the number of cylinders is not limited thereto and can be freely changed, as appropriate.

In the each cylinder 13 of the internal combustion engine 10, repeated are an intake stroke for intake of air-fuel mixture into the cylinder 13, a compression stroke for compressing the air-fuel mixture in the cylinder 13 by moving-up of a piston 204, a combustion stroke for combustion of the air-fuel mixture by applying current to a plug (not shown), and an exhaust stroke for exhausting the combustion gas from the cylinder 13. Various controls, such as control of applying current to the plug, control of supplying air-fuel mixture, and the like in the internal combustion engine 10 are performed by the onboard ECU 40.

The internal combustion engine 10 is a multi-cylinder internal combustion engine provided with the cylinders 13, pistons 204 fitted to the respective cylinders 13 to be able to reciprocally move, and a crank shaft 12 connected to the respective pistons 204 through respective connecting rods 205. The internal combustion engine 10 is mounted on a vehicle as a mounting object, being horizontally disposed such that the rotational center line of the crank shaft 12 extends in the left/right direction.

The internal combustion engine 10 is provided with an engine main body structured by the cylinder block 201 arranged integrally with the serially-arrayed four cylinders 13, a cylinder head 202 joined with the upper end portion of the cylinder block 201, and a head cover 203 joined with the upper end portion of the cylinder head 202.

For each cylinder 13, a combustion chamber 207 is formed by the cylinder 13, the piston 204, and the cylinder head 202, between the piston 204 and the cylinder head 202 with respect to the cylinder axis line direction, which is parallel with the cylinder axis line Lc of the cylinder 13.

Incidentally, in the present specification, the axial direction is defined to be the direction parallel with the rotational center lines Li, Le of camshafts 221*i*, 221*e* of the valve gear 20A.

In the present embodiment, in a view from the axial direction (hereinafter, referred to as 'axial direction view'), a perpendicular direction is defined to be a direction perpendicular to the cylinder axial line Lc, and the front/rear direction is assumed to be the same as the front/rear direction of the vehicle. The upward side with respect to the cylinder perpendicular plane, which is a plane perpendicular to the cylinder axial line Lc, will be referred to as the upper side, and the downward side will be referred to as the lower side.

The cylinder head 202 disposed on the upper side of the cylinder block 201 with respect to the cylinder axial direction is provided with, for the each cylinder 13 (in other words, for each combustion chamber 207): an intake port 208 having a pair of intake openings and an exhaust port 209 having a pair of exhaust opening, the intake openings and the exhaust openings being open to the combustion chamber 207; the intake valve 210 as a pair of first engine valves and the exhaust valve 211 as a pair of second engine valves, the first engine valves and the second engine valves respectively opening and closing the pair of intake openings and the pair of exhaust openings; and a spark plug 212 adjoining the combustion chamber 207. The spark plug 212 is disposed, together with a spark coil, inside a cylindrical housing cylinder 213, which is provided together with a spark coil to the cylinder head 202. The housing cylinder 213 is formed integrally with the cylinder head 202 and fits with a cylindrical housing portion provided with a fitting hole for fitting the spark plug 212.

The internal combustion engine 10 includes: in addition to the valve gear 20A, which is disposed inside a valve chamber 215 formed by the cylinder head 202 and the head cover 203 and drives the intake valve 210 and the exhaust valve 211 to open and close these; an intake device 216, which is fitted to the intake side of the cylinder head 202 and guides intake air taken in from outside the internal combustion engine 10 to the combustion chamber 207 through the intake port 208; a fuel injection nozzle (not shown), which is fitted the intake side of the cylinder head 2 and injects fuel that forms air-fuel mixture with intake air; and an exhaust device 217, which is fitted to the exhaust side of the cylinder head 202 and guides combustion gas generated in the combustion chamber 207 by combustion of the air-fuel mixture to outside the internal combustion engine 10 through an exhaust port 209 as exhaust gas. The exhaust device 217 includes a catalyst device 217*a* as an exhaust gas cleaning device.

The piston 204 is driven by the pressure of combustion gas generated by combustion, upon ignition by the spark plug 212, of the air-fuel mixture in the combustion chamber 207. The piston 204 is thus driven to reciprocally move and thereby rotationally drives the crank shaft 12 via the connecting rod 205.

Incidentally, the intake side refers to the side on which the whole or the most part of the intake valve 210 is located with respect to the cylinder center plane that includes the cylinder axial line Lc of a cylinder 1*a* and is parallel with the rotational center lines Li, Le. The exhaust side refers to the side on which the whole or the most part of the exhaust valve 211 is located with respect to the cylinder center plane.

In the present embodiment, the internal combustion engine 10 is mounted with an inclination from the vehicle body such that the cylinder axial line Lc is forward tilting with a certain tilt angle from the vertical direction. The intake side on the rear side, of the engine main body, is disposed higher than the exhaust side on the front side.

The valve gear 20A includes: camshafts, which are an intake camshaft 221*i* as a first camshaft having an intake cam 222*i* as a first valve cam and an exhaust camshaft 221*e* as a second camshaft having an exhaust cam 222*e* as a second valve cam; an intake rocker arm 225*i* and an exhaust rocker arm 225*e*, which contact respectively with the intake valve 210 and the exhaust valve 211 and are driven respectively by an intake cam 222*i* and an exhaust cam 222*e* to open and close the intake valve 210 and the exhaust valve 211; valve springs 226 that always urge the intake valve 210 and the exhaust valve 211 in the valve closing direction; and rotational drive members (not shown) for rotationally driving the respective intake camshafts 221*i*, 221*e* (in other words, the respective cams 222*i*, 222*e*) in synchronization with the rotation of the crank shaft 12. These intake camshaft 221*i* and exhaust camshaft 221*e* are provided parallel to the crank shaft 12.

The respective intake rocker arm 225*i* and exhaust rocker arm 225*e* are supported, to be able to oscillate, by lash adjusters 227 as support members arranged in the cylinder head 202. The intake cam 222*i* and the exhaust cam 222*e* respectively drive and thereby open and close the intake valve 210 and the exhaust valve 211 via the intake rocker arm 225*i* and the exhaust rocker arm 225*e*.

Detailed Structure of Valve Gear

Figures 3A, 3B:
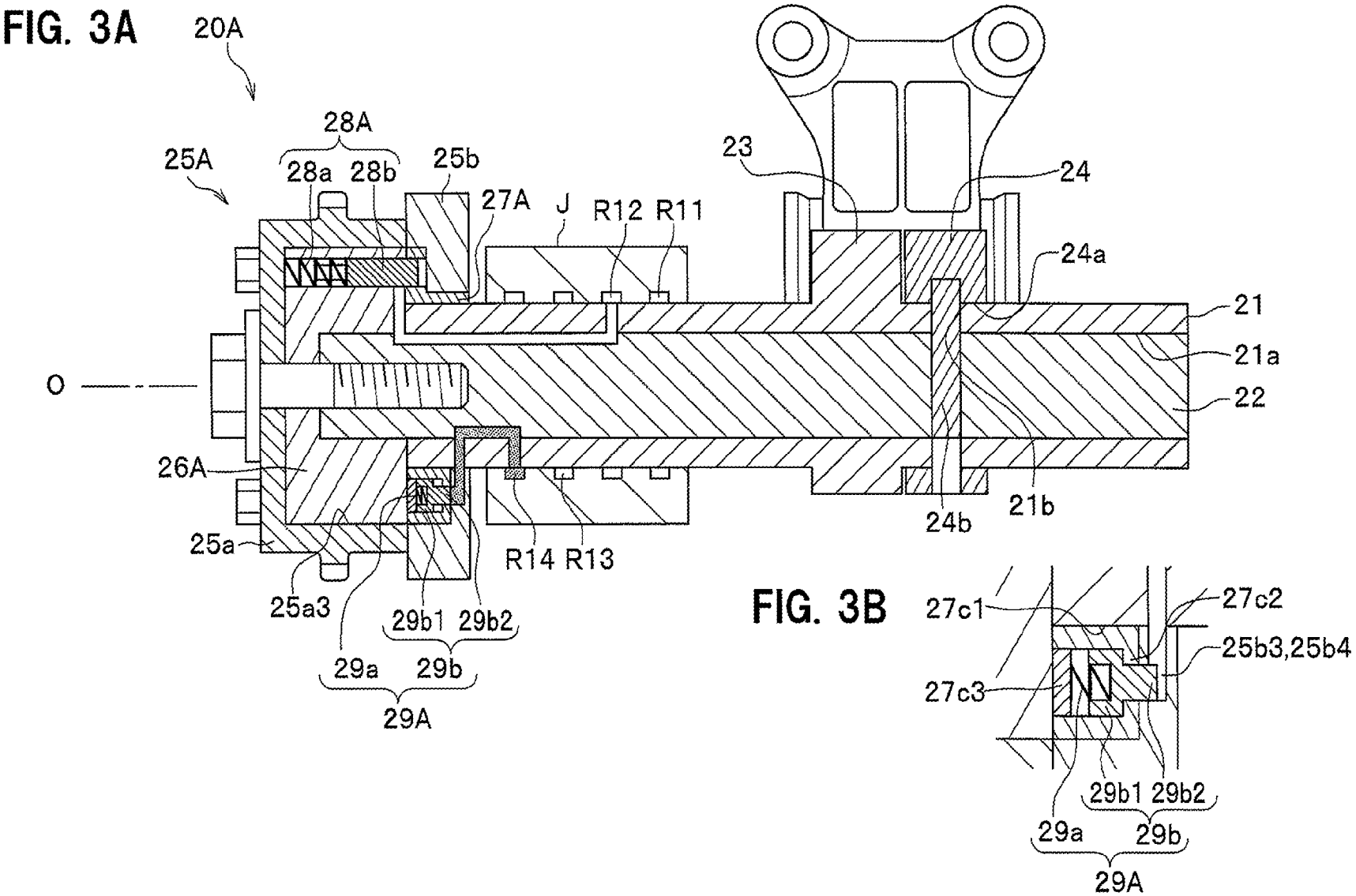
FIG. 3A is a cross-sectional view showing a valve gear in the first embodiment.
FIG. 3B is an enlarged cross-sectional view showing a second connecting member.

In the following, the detailed configuration of the valve gear in the present embodiment of the invention will be described. The valve gear 20A is a device for driving the intake valve 210 and the exhaust valve 211 of the internal combustion engine 10. The valve gear 20A is a hydraulic device capable of changing the valve opening timing and changing the valve open period of the intake valve 210, based on control by the ECU 40. The structure for driving the intake valve 210 will be described below, and the structure of driving the exhaust valve 211 will be omitted. As shown in FIG. 3A, the valve gear 20A includes a first camshaft 21, a second camshaft 22, a first cam piece 23, a second cam piece 24, a housing 25A, the first vane rotor 26A, the second vane rotor 27A, the first connecting member 28A, and the second connecting member 29A. Among these, the combination of the first camshaft 21, the second camshaft 22, the housing 25A, first vane rotor 26A, the second vane rotor 27A, the first connecting member 28A, and the second connecting member 29A is also called a variable valve timing mechanism. Incidentally, the cross-sectional views of the valve gear 20A in FIG. 3A and after are drawn such that the cross-sectional position is switched, as appropriate, wherein the first connecting member 28A and the second connecting member 29A are drawn.

First Camshaft

The first cam shaft 21 is a part of the above-described intake cam shaft 221*i*, and is a member having a hollow cylindrical shape with a hollow portion 21*a*. The hollow portion 21*a* is extended along the axial direction of the first cam shaft 21, and has a hollowed exact circle shape in a view along the axial direction. The first cam shaft 21 is rotatable with the central axis of the first cam shaft 21 itself as a rotation axis O. Further, the first cam shaft 21 is provided with a hole portion 21*b* having a long hole shape making the hollow portion 21*a* and the outside communicate with each other. The hole portion 21*b* is formed such as to penetrate through the first cam shaft 21, along the radial direction (a direction perpendicular to the axial direction) of the first cam shaft 21, and has an opening through the outer circumferential surface of the first cam shaft 21.

Second Camshaft

The second cam shaft 22 is another part of the above-described intake cam shaft 221*i*, and is a member having a solid cylindrical shape. The diameter of the second cam shaft 22 is substantially equal to the diameter of the hollow portion 21*a* of the first cam shaft 21. Thus formed second cam shaft 22 is disposed inside the hollow portion 21*a* of the first cam shaft 21, and is rotatable independently from the first cam shaft 21, with the central axis of the second cam shaft 22 itself as the rotation axis O. That is, the central axis of the first cam shaft 21 and the central axis of the second cam shaft 22 agree with each other.

First Cam Piece

The first cam piece 23 is a part of the above-described intake cam 222*i* and is prohibited to rotate relative to the first cam shaft 21 (allowed to integrally rotate). In the present embodiment, the first cam piece 23 is formed integrally with the first cam shaft 21.

Second Cam Piece

The second cam piece 24 is another part of the above-described intake cam 222*i*, and is prohibited to rotate relative to the second cam shaft 22 (allowed to integrally rotate). In the present embodiment, the second cam piece 24 is provided with a hole portion 24*a* which the first cam shaft 21 penetrates through rotatably relative to the second cam piece 24. Further, the second cam piece 24 is connected to the second cam shaft 22 by a connecting pin 24*b* via the hole portion 21*b* formed through the first cam shaft 21.

Housing

The housing 25A is a member for housing the first vane rotor 26A, the second vane rotor 27A, the first connecting member 28A, and the second connecting member 29A, wherein one end portions of the first cam shaft 21 and the second cam shaft 22 are inserted in the housing 25A. The housing 25A arranged in such a way is provided with a hollow cylindrical portion 25*a* and a wall surface portion 25*b*.

Figure 4A:
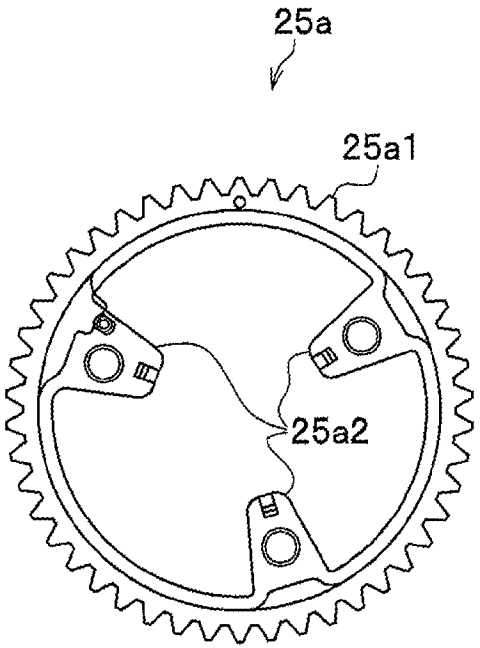
FIG. 4A to 4D are diagrams showing a hollow cylindrical portion, a wall surface portion, a first vane rotor, and a second vane rotor in the first embodiment, respectively.

The hollow cylindrical portion 25*a* is a member having a bottomed and hollow cylindrical shape for housing the first vane rotor 26A, the second vane rotor 27A, and the like, and is, as shown in FIG. 4A, provided with a teeth portion 25*a*1 provided at the outer circumference, and a plurality (three in the present embodiment) of stoppers 25*a*2 provided at the inner circumference. The teeth portion 25*a*1 is connected to the crank shaft 12 of the vehicle via a chain (not shown), which is a power transmission member, wherein when the internal combustion engine 10 is started, rotation of the crank shaft 12 is transmitted to the hollow cylindrical portion 25*a* via the chain, and the hollow cylindrical portion 25*a*, in other words, the housing 25A rotates in the advance angle direction in FIG. 5A. The number of stoppers 25*a*2 is three equal to the number of later-described protruding portions 26*b*, 26*c*, and 26*d* of the first vane rotor 26A, wherein the three stoppers 25*a*2 are disposed with equal intervals along the circumferential direction of the hollow cylindrical portion 25*a*. Between the neighboring stoppers 25*a*2, there are formed the movement regions of the later-described protruding portions 26*b*, 26*c*, and 26*d* of the first vane rotor 26A and protruding portions 27*b* and 27*c* of the second vane rotor 27A.

The wall surface portion 25*b* is a member having a disc shape with a diameter substantially the same as the diameter of the hollow cylindrical portion 25*a*, and is provided such as to close the opening of the hollow cylindrical portion 25*a*. The wall surface portion 25*b* arranged in such a manner is provided with a central hole 25*b*1, wherein the second cam shaft 22 and the hollow cylindrical portion 27*a* of the second vane rotor 27A are rotatably inserted thorough the central hole 25*b*1. The inner surface of the wall surface portion 25*b* is provided with a recessed housing portion 25*b*2, which houses the protruding portions 27*b* and 27*c* of the second vane rotor 27A, and recessed portions 25*b*3 and 25*b*4, which allow the pin 29*b* of the second connecting member 29A to move forward and backward. Herein, the recessed portion 25*b*3 is formed at a position corresponding to the most delayed angle position of the protruding portions 27*c*, and the recessed portion 25*b*4 is formed at a position corresponding to the most advanced angle position of the protruding portions 27*c*.

Incidentally, in the present embodiment and the later-described second embodiment, the teeth portion 25*a*1, around which a chain is wound, is provided at the outer circumference of the hollow cylindrical portion 25*a*, however, a teeth portion may be provided at the outer circumference of the wall surface portion 25*b* instead of the hollow cylindrical portion 25*a*.

First Vane Rotor

As shown in FIG. 3A, the first vane rotor 26A is rotatably movable relative to the housing 25A, and is connected to the second cam shaft 22, being prohibited to rotate relative to the second cam shaft 22.

Figure 4B:
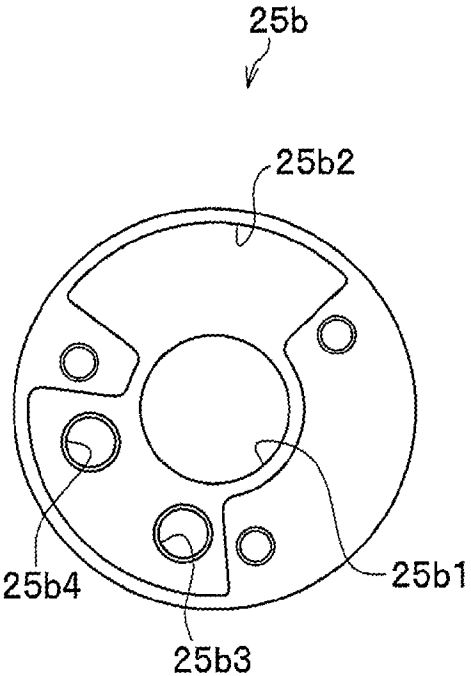
Figure 4C:
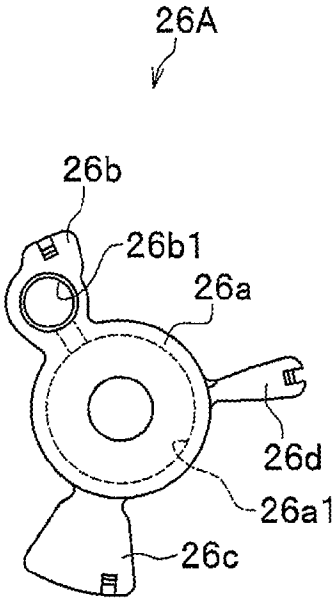
Figure 4D:
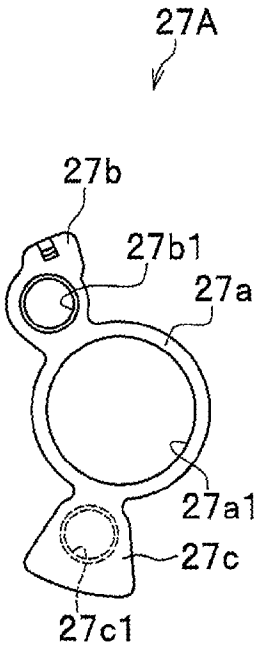

The first vane rotor 26A is, as shown in FIG. 4C, provided with a hollow cylindrical portion 26*a* connected to the second cam shaft 22, and three protruding portions 26*b*, 26*c*, and 26*d* protruding outward in the radial direction from the hollow cylindrical portion 26*a*. The second cam shaft 22 is inserted in and fixed to the central recessed portion 26*a*1 of the hollow cylindrical portion 26*a*. The three protruding portions 26*b*, 26*c*, and 26*d* are disposed with substantially equal intervals along the circumferential direction of the hollow cylindrical portion 26*a*. The protruding portions 26*b* and 26*c* are substantially in a fan shape, wherein the protruding portion 26*b* is provided with a recessed portion 26*b*1 in which the first connecting member 28A is arranged. The thickness of the first vane rotor 26A (in details, the protruding portions 26*b*, 26*c*, and 26*d*) arranged in such a manner is equal to the depth of the housing portion 25*a*3 of the hollow cylindrical portion 25*a*.

Second Vane Rotor

As shown in FIG. 3A, the second vane rotor 27A and the first vane rotor 26A are lined up along the rotation axis O direction, being rotatable relative to the housing 25A, and is connected to the first cam shaft 21, being prohibited to relatively rotate to the first cam shaft 21.

As shown in FIG. 4, the second vane rotor 27A is provided with the hollow cylindrical portion 27*a* connected to the first cam shaft first cam shaft 21, and the two protruding portions 27*b*, 27*c* protruding outward in the radial direction from the hollow cylindrical portion 27*a*. The first cam shaft 21 is inserted in and fixed to the central hole 27*a*1 of the hollow cylindrical portion 27*a*. The protrusion lengths of the two protruding portions 27*b*, 27*c* are equal to the protrusion lengths of the protruding portions 26*b*, 26*c* of the first vane rotor 26A, wherein the protrusion directions of the two protruding portions 27*b*, 27*c* agree with the protrusion directions of the protruding portions 26*b*, 26*c* of the first vane rotor 26A.

The thickness, along the rotation axial direction O, of the protruding portions 27*b*, 27*c* is equal to the depth of the recessed housing portion 25*b*2 formed at the wall surface portion 25*b*(see FIG. 4B). The protruding portions 27*b*, 27*c* are provided respectively with hole portions 27*b*1, 27*c*1 in which the first connecting member 28A and the second connecting member 29A can be inserted. The hole portion 27*b*1 is formed at a position corresponding to the recessed portion 26*b*1 of the above-described first vane rotor 26A in a view of the axial direction (in a view from the rotation axis O direction). The hole portion 27*b*2 is formed at a position corresponding to the recessed portion 25*b*3 of the above-described wall surface portion 25*b* in the view of the axial direction. As the second vane rotor 27A thus arranged is thin, the hydraulic pressure acting thereon is low, and accordingly, the second vane rotor 27A cannot rotate alone.

In the present embodiment, the thickness of the first vane rotor 26A along the rotation axis O direction (the thicknesses of the protruding portions 26*b*, 26*c*, and 26*d* in more details) is larger than the thicknesses of the second vane rotor 27A along the rotation axis O direction (the thicknesses of the protruding portions 27*b* and 27*c* in more details). Incidentally, if the space along the rotation axis O direction has a room, the thickness of the first vane rotor 26A and the thickness of the 27A may be set equal.

Oil Passage

The above-described first cam shaft 21 is rotatably supported by a bearing J. Oil passages R11-R14 are formed on the bearing J, the first cam shaft 21, the second cam shaft 22, the wall surface portion 25*b*, the first vane rotor 26A, and the second vane rotor 27A. Among the above-described oil passages R11-R14, the oil passage R11 is a delay angle oil passage for rotating the first vane rotor 26A and the second vane rotor 27A in the delay angle direction, and the oil passage R12 is an advance angle oil passage for rotating the first vane rotor 26A and the second vane rotor 27A in the advance angle direction. The oil passage R13 is a connecting oil passage for connection by the second connecting member 29A, and the oil passage R14 is a release oil passage for releasing the connection by the second connecting member 29A. Delay angle oil chambers R11*a* are arranged between the above-described protruding portions 26*b*, 27*b* and the advance angle side surfaces of the corresponding stoppers 25*a*2, between the protruding portions 26*c*, 27*c* and the advance angle side surfaces of the corresponding stoppers 25*a*2, and between the protruding portion 26*d* and the advance angle side surface of the corresponding stopper 25*a*2, respectively on the delay angle oil passage R11 (see FIG. 5). Advance angle oil chambers R12*a* are arranged between the above-described protruding portions 26*b*, 27*b* and the delay angle side surfaces of the corresponding stoppers 25*a*2, between the protruding portions 26*c*, 27*c* and the delay angle side surfaces of the corresponding stoppers 25*a*2, and between the protruding portion 26*d* and the delay angle side surface of the corresponding stopper 25*a*2, respectively on the advance angle oil passage R12 (see FIG. 6). Incidentally, the delay angle oil passage R11 serves also as a release oil passage for releasing the connection by the first connecting member 28A.

First Connecting Member

As shown in FIG. 3A, the first connecting member 28A is a member capable of connecting the first vane rotor 26A and the second vane rotor 27A. The first connecting member 28A is provided with a spring 28*a* housed on the bottom side of the recessed portion 26*b*1, and a pin 28*b* housed on the opening side of the recessed portion 26*b*1 and urged toward the second vane rotor 27A by this spring 28*a*.

This pin 28*b* moves forward toward the second vane rotor 27A and backward, wherein the length of forward and backward movement is substantially equal to or shorter than the axial direction length of the hole portion 27*b*1 of the second vane rotor 27A. If the position of the pin 28*b* agrees with the position of the hole portion 27*b*1, and the hydraulic pressure is not supplied to the delay angle oil passage R11, the pin 28*b* forward moves by the urging force of the spring 28*a* to be inserted into the recessed portion 27*b*1 of the second vane rotor 29A, and the first connecting member 28A prohibits relative rotation between the first vane rotor 26A and the second vane rotor 27A. If hydraulic pressure is supplied to the delay angle oil passage R11, oil fills the space between the tip end of the pin 28*b* and the recessed portion 27*b*1, and the pin 28*b* moves backward against the urging force of the spring 28*a* by the hydraulic pressure to move out from the recessed portion 27*b*1 of the second connecting member 29A, and the first connecting member 28A permits relative rotation between the first vane rotor 26A and the second vane rotor 27A.

Second Connecting Member

As shown in FIGS. 3A and 3B, the second connecting member 29A is a member that is provided in the recessed portion 27*c*1 and is capable of connecting the second vane rotor 27A and the wall surface portion 25*b*. The second connecting member 29A is provided with a spring 29*a* housed on the bottom side of the recessed portion 27*c*1, and a pin 29*b* housed on the opening side of the recessed portion 27*c*1 to be urged toward the wall surface portion 25*b* by this spring 29*a*. The pin 29*b* has a larger diameter portion 29*b*1 on the root end side and a smaller diameter portion 29*b*2 on the tip end side. The opening portion of the above-described recessed portion 27*c*1 is a move-off preventing portion 27*c*2 with a diameter slightly larger than the smaller diameter portion 29*b*2 and smaller than the larger diameter portion 29*b*1, wherein the larger diameter portion 29*b*1 of the pin 29*b* contacts the move-off preventing portion 27*c*2 in a state that the smaller diameter portion 29*b*2 of the pin 29*b* is protruding from the opening portion of the recessed portion 27*c*1, and forward movement of the pin 29*b* is thereby restricted. This recessed portion 27*c*1 is formed by pressure-fitting a lid member 27*c*3 to the opening, on the first vane rotor 26A side, of a penetration hole formed through the second vane rotor 27A to close the opening in a state that the spring 29*a* and the pin 29*b* are housed in the penetration hole. Incidentally, FIG. 3B shows a state that the pin 29*b* has moved forward to the recessed portion 25*b*3 (25*b*4).

This pin 29*b* moves forward, toward the wall surface portion 25*b*, and backward, wherein the length of forward and backward movement of the pin 29*b* is equal to or shorter than the axial direction length of the recessed portions 25*b*3, 25*b*4 of the wall surface portion 25*b*. If the position of the pin 29*b* agrees with the position of the recessed portion 25*b*3 or the recessed portion 25*b*4, and hydraulic pressure is supplied to the connecting oil passage R13 and hydraulic pressure is not supplied to the release oil passage R14, the space between the root end of the pin 29*b* and the recessed portion 27*c*1 is filled with oil. Thus, the pin 29*b* moves forward by the hydraulic pressure and the urging force of the spring 29*a* to be inserted into the recessed portion 25*b*3 or the recessed portion 25*b*4 of the wall surface portion 25*b*, and the second connecting member 29A prohibits relative rotation between the second vane rotor 27A and the wall surface portion 25*b*. If hydraulic pressure is not supplied to the connecting oil passage R13 and hydraulic pressure is supplied to the release oil passage R14, the space between the tip end of the pin 29*b* and the recessed portion 25*b*3 or the recessed portion 25*b*4 is filled with oil, and the pin 29*b* moves backward against the urging force of the spring 29*a* by the hydraulic pressure to get out from the recessed portion 25*b*3 or the recessed portion 25*b*4 of the wall surface portion 25*b*. Thus, the second connecting member 29A permits relative rotation between the second vane rotor 27A and the wall surface portion 25*b*. When the second vane rotor 27A moves relative to the wall surface portion 25*b*, the tip end of the pin 29*b* slides on the inner surface of the wall surface portion 25*b*.

Example of Control

In the following, an example of control by the ECU 40 of the valve gear 20A in the first embodiment of the invention will be described in the order of control at the time when the internal combustion engine 10 is stopped, advance angle control after startup of the internal combustion engine 10, delay angle control, and open angle control after the most advanced angle control. Incidentally, as the chain wound around the teeth portion 25*a*1 urges the housing 25A in the advance angle direction, a cam average torque acts on the first vane rotor 26A and the second vane rotor 27A to rotate these relative to the housing 25A in the delay angle direction.

Incidentally, the valve system 1A is provided with a known cam angle sensor for detecting the rotation angle (attitude) of a camshaft, wherein the ECU 40 performs feedback control of the hydraulic pressures of the delay angle oil passage R11 and the advance angle oil passage R12 so that a real rotation angle detected by the cam angle sensor agrees with a target angle.

Control at Time when Internal Combustion Engine is Stopped

Figure 5A:
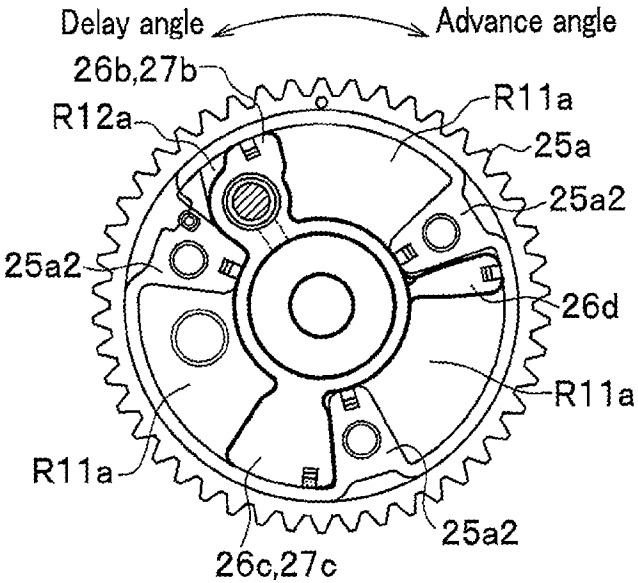
FIGS. 5A-5E are diagrams showing an example of controlling the valve gear in the first embodiment and showing a state at the time when the internal combustion engine is stopped.
Figure 5B:
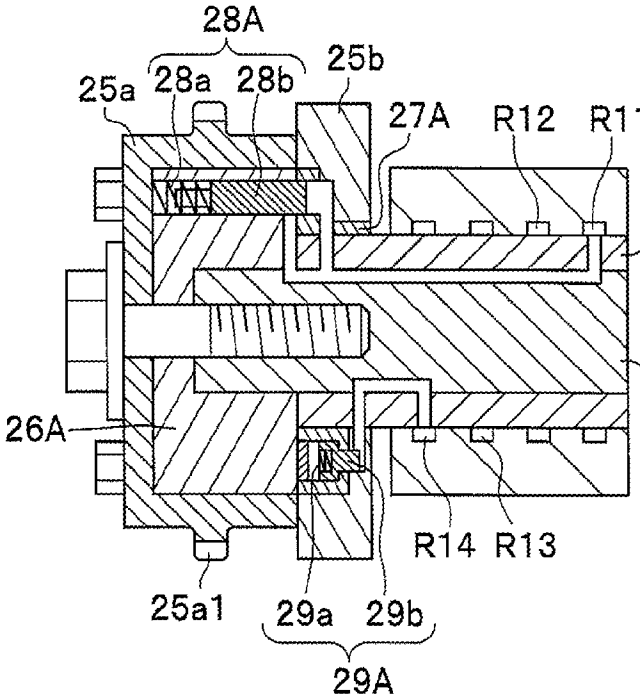
Figure 5C:
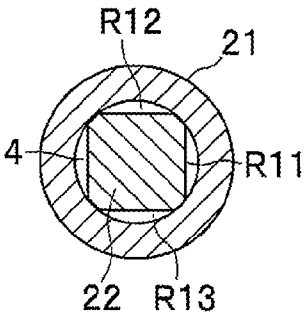
Figure 5D:
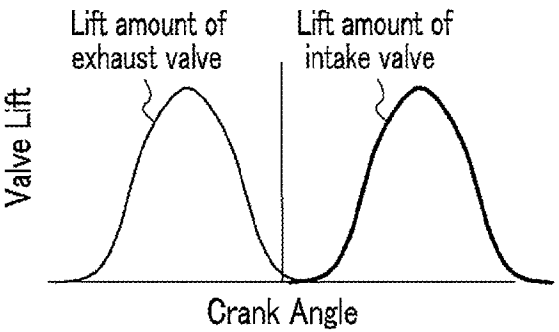
Figure 5E:
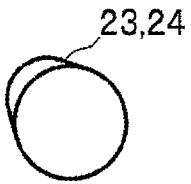

First, a state at the time when the internal combustion engine 10 is stopped will be described, referring to FIGS. 5A-5E. FIG. 5A is a diagram for illustration of the attitudes of the first van rotor and the second vane rotor at the time when the internal combustion engine is stopped. FIG. 5B is a diagram for illustration of the state of the first connecting member and the second connecting member. FIG. 5C is a schematic diagram for illustration of oil passages. FIG. 5D is a graph representing the relationship between the crank angle and the lift amount of a valve. FIG. 5E is a diagram for illustration of the attitudes of the first cam piece and the second cam piece. In the following description, the diagram for illustration of the attitudes of the first van rotor and the second vane rotor shows the hollow cylindrical portion 25*a*, the first vane rotor 26A, the second vane rotor 27A, and the wall surface portion 25*b* in a view from the left side in FIG. 3A (except the bottom surface of the hollow cylindrical portion 25*a*). The schematic diagram for illustration of the oil passages represents oil passages to which hydraulic pressure is supplied by dots, and represents oil passages to which hydraulic pressure is not supplied by hollow.

As shown in FIGS. 5A-5E, when the internal combustion engine 10 stop, the first vane rotor 26A and the second vane rotor 27A are located at the most delayed angle positions. That is, the delay angle side surfaces of the protruding portions 26*b*, 26*c*, and the 26*d* of the first vane rotor 26A contact the advance angle surfaces of the stoppers 25*a*2, and the delay angle side surfaces of the protruding portions 27*b* and 27*c* of the second vane rotor 27A contact the advance angle side surfaces of the stoppers 25*a*2. That is, the first vane rotor 26A and the second vane rotor 27A are in the same phase; the protruding portion 26*b* and the protruding portions 27*b* are superimposed with each other; and the protruding portion 26*c* and the protruding portion 27*c* are superimposed with each other.

As the internal combustion engine 10 is stopped and oil supply is stopped, the pin 28*b* is urged by the spring 28*a* to move forward to the hoe portion 27*b*1. Thus, the first connecting member 28A becomes into a state of connecting the first vane rotor 26A and the second vane rotor 27A, and the pin 29*b* is urged by the spring 29*a* to move forward to the recessed portion 25*b*3. The second connecting member 29A is thereby in a state of connecting the second vane rotor 27A and the wall surface portion 25*b*.

In such a state, as shown in FIG. 5E, the first cam piece 23 and the second cam piece 24 integrally move to the most delayed angle side, and as shown in FIG. 5D, the valve open period of the intake valve 210 does not overlap with the valve open period of the exhaust valve 211.

Advance Angle Control After Internal Combustion Engine Starts

Figure 6A:
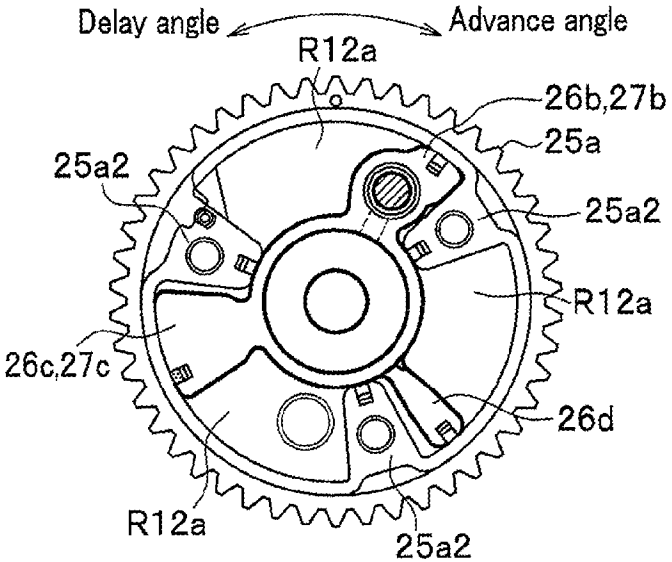
FIGS. 6A-6E are diagrams showing an example of controlling the valve gear in the first embodiment and showing a state that advance angle control is performed after startup of the internal combustion engine.
Figure 6B:
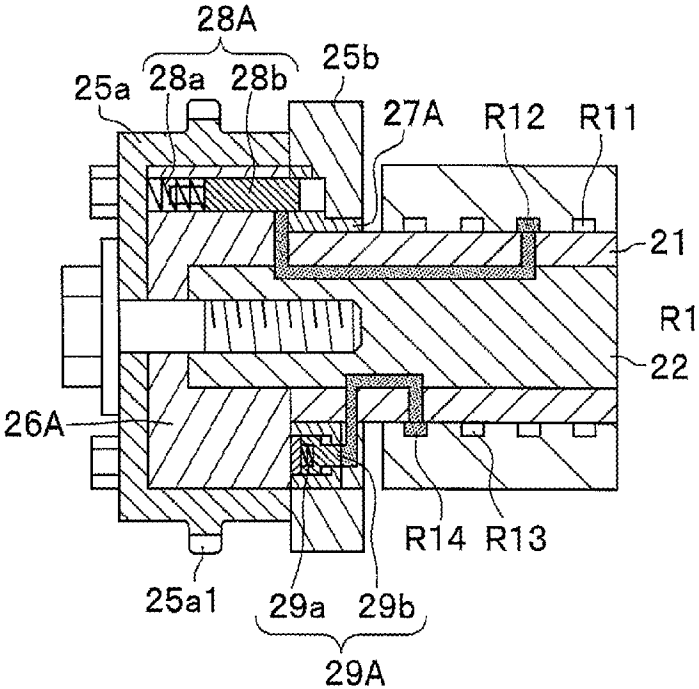
Figure 6C:
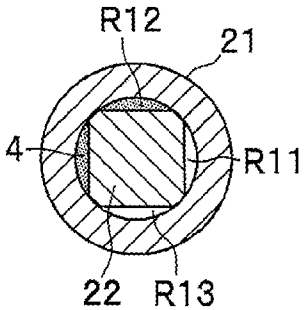
Figure 6D:
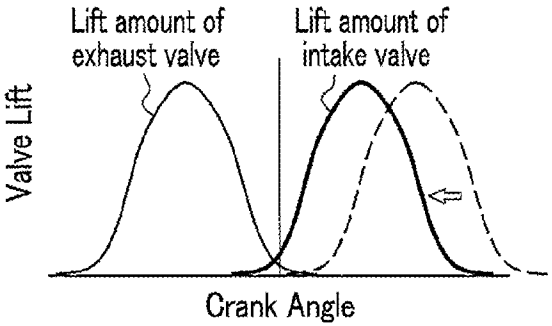
Figure 6E:
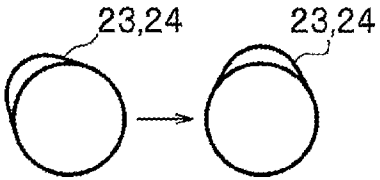

In the following, advance angle control after the internal combustion engine 10 starts will be described, referring to FIGS. 6A-6E. FIG. 6A is a diagram for illustration of the attitudes of the first vane rotor and the second vane rotor in advance angle control after the internal combustion engine starts. FIG. 6B is a diagram for illustration of a state of the first connecting member and the second connecting member. FIG. 6C is a schematic diagram for illustration of oil passages. FIG. 6D is a graph representing the relationship between the crank angle and the lift amount of a valve. FIG. 6E is a diagram for illustration of the attitudes of the first cam piece and the second cam piece. FIGS. 6A-6E are diagrams showing a case of the most advanced angle control in rotating to the most advanced angle direction in advance angle control.

As shown in FIGS. 6A-6E, after the internal combustion engine 10 is started, in case of performing advance angle control of the first cam piece 23 and the second cam piece 24, the pin 29*b* moves backward out from the recessed portion 25*b*3 by hydraulic pressure by setting, from the state in FIG. 5, the delay angle oil passage R11 to hydraulic pressure OFF, the advance angle oil passage R12 to hydraulic pressure ON, the connecting oil passage R13 of the second connecting member 29A to hydraulic pressure OFF, and the release oil passage R14 of the second connecting member 29A to hydraulic pressure ON. Thus, the second connecting member 29A becomes into a state of releasing the connection between the second vane rotor 27A and the wall surface portion 25*b*, and the first vane rotor 26A and the second vane rotor 27A connected by the first connecting member 28A are urged and rotated clockwise with respect to FIG. 6A, in other words, in the advance angle direction by the hydraulic pressure of the advance angle oil chambers R12*a*. The amounts of the advance angle (angle of advance angle) of the first vane rotor 26A and the second vane rotor 27A can be made a desired advance angle amount by performing duty control on the hydraulic pressure of the advance angle oil passage R12.

In such a state, as shown in FIG. 6E, the first cam piece 23 and the second cam piece 24 are integrally moved to the advance angle side, and as shown in FIG. 6D, in case of the most advanced angle control, the first half of the valve open period of the intake valve 210 overlaps with the second half of the valve open period of the exhaust valve 211.

Delay Angle Control

Figure 7A:
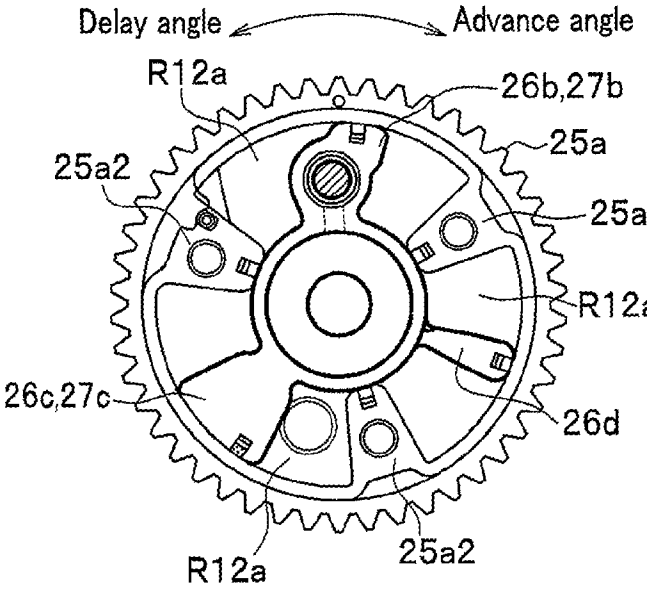
FIGS. 7A-7E are diagrams showing an example of controlling the valve gear in the first embodiment and showing a state that delay angle control is performed.
Figure 7B:
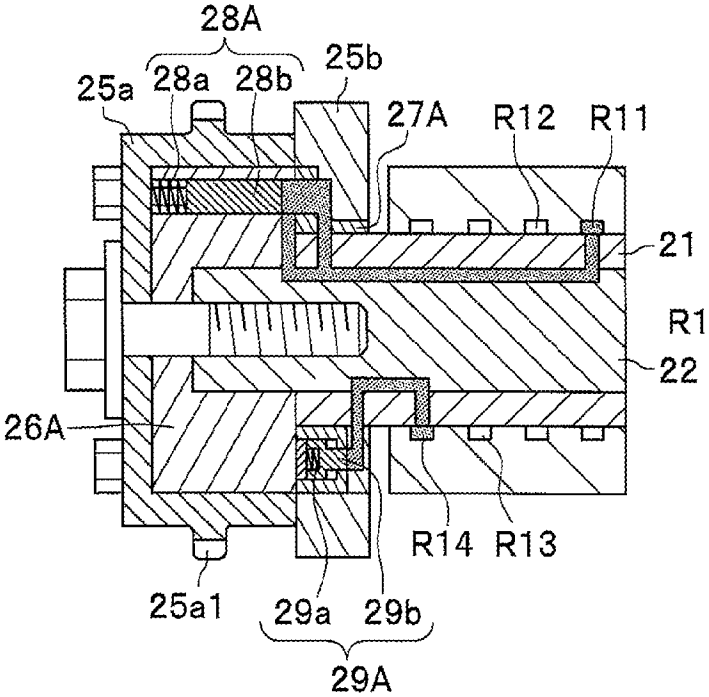
Figure 7C:
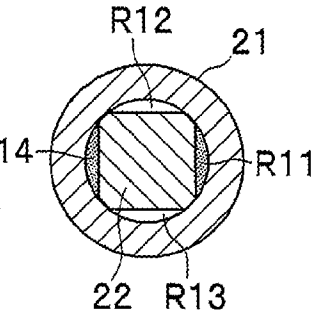
Figure 7D:
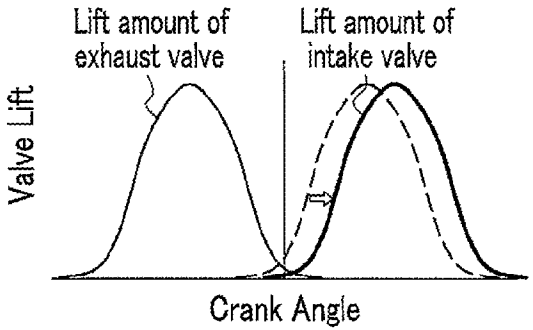
Figure 7E:
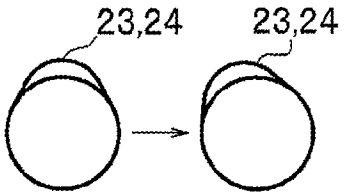

In the following, referring to FIGS. 7A-7E, the delay angle control will be described. FIG. 7A is a diagram for illustration of the attitudes of the first vane rotor and the second vane rotor in delay angle control. FIG. 7B is a diagram for illustration of the state of the first connecting member and the second connecting member. FIG. 7C is a schematic diagram for illustration of the oil passages. FIG. 7D is a graph representing the relationship between the crank angle and the lift amount of a valve. FIG. 7E is a diagram for illustration of the attitudes of the first cam piece and the second cam piece.

As shown in FIGS. 7A-7E, in case of performing delay angle control of the first cam piece 23 and the second cam piece 24 after advance angle control, for example, from the state shown FIGS. 6A-6E, by setting hydraulic pressure ON of the delay angle oil passage R11, hydraulic pressure OFF of the advance angle oil passage R12, hydraulic pressure OFF of the connecting oil passage R13 of the second connecting member 29A, and hydraulic pressure ON of the release oil passage R14 of the second connecting member 29A, the pin 28*b* provided in the recessed portion 26*b*1 moves backward out from the hole portion 27*b*1 by hydraulic pressure; thus the first connecting member 28A becomes into a state of having released the connection between the first vane rotor 26A and the second vane rotor 27A; the second vane rotor 27A rotates in the delay angle direction slightly ahead the first vane rotor first vane rotor 26A by the cam average torque; and the first vane rotor 26A is urged and rotated to the counterclockwise side with respect to FIG. 7A, namely in the delay angle direction, by the hydraulic pressure of the delay angle oil chambers R11*a*. As a sufficient hydraulic pressure does not act on the second vane rotor 27A, a sufficient torque, which is enough to press the intake rocker arm 225*i*, does not act on the first cam piece 23, which is connected to the second vane rotor 27A through the first cam shaft 21, and on the contrary, the first cam piece 23 is urged in the advance angle direction by the intake rocker arm 225*i* to become into the same phase as the second cam piece 24. That is, the second vane rotor 27A is urged to rotate in the advance angle direction by the intake rocker arm 225*i*, and becomes into the same phase as the first vane rotor 26A. The delay angle amount (angle of the delay angle) of the first vane rotor 26A and the second vane rotor 27A can be made desired delay angle amounts by duty control of the hydraulic pressure of the delay angle oil passage R11. Further, in a state that the first vane rotor 26A and the second vane rotor 27A have become in the same phase, if the hydraulic pressure of the delay angle oil passage R11 also serving as the release oil passage for releasing the connection by the first connecting member 28A is lower than the urging force of the spring 28*a*, the pin 29*b* moves forward to the hole portion 27*b*1 by the urging force of the spring 28*a*, and the first connecting member 28A connects the first vane rotor 26A and the second vane rotor 27A. In such a manner, after the internal combustion engine 10 starts, the valve gear 20A can make the integral attitude of the first cam piece 23 and the second cam piece 24 to be a desired attitude between the most delayed angle and the most advanced angle by advance angle control and delay angle control.

Most Delayed Angle Control

As an example delay angle control, in case of performing the most delayed angle control of the first cam piece 23 and the second cam piece 24 immediately before the internal combustion engine 10 stops, by setting hydraulic pressure ON of the delay angle oil passage R11, hydraulic pressure OFF of the advance angle oil passage R12, hydraulic pressure OFF of the connecting oil passage R13 of the second connecting member 29A, and hydraulic pressure ON of the release oil passage R14 of the second connecting member 29A, the first connecting member 28A becomes into a state of having released the first vane rotor 26A and the second vane rotor 27A, and the second connecting member 29A becomes into a state of having released the connection between the second vane rotor 27A and the wall surface portion 25*b*. That is, independent rotations of the first vane rotor 26A and second vane rotor 27A relative to the wall surface portion 25*b* are permitted, wherein the first vane rotor 26A, which is thick and has a sufficient pressure receiving area, is urged to rotate to the counterclockwise side shown with respect to FIG. 5A, namely the delay angle direction, by the hydraulic pressure of the delay angle oil chamber R11*a*, and the delay angle side surfaces of the protruding portions 26*b*, 26*c*, and 26*d* contact the advance angle side surface of the stopper 25*a*2, In comparison, the second vane rotor 27A, which is thin and does not have a sufficient pressure receiving area, does not rotate in the delay angle direction by the hydraulic pressure of a delay angle oil chamber 11*a* alone but rotates in the delay angle direction by a cam average torque, and the delay angle side surfaces of the protruding portions 27*b*, 27*c* contact the advance angle side surfaces of the stoppers 25*a*2 so that the second vane rotor 27A becomes into the same phase as the first vane rotor 26A.

In such an embodiment, the first cam piece 23 and the second cam piece 24 have integrally moved to the most delay angle side as shown in FIG. 5E, the valve open period of the intake valve 210 does not overlap with the valve open period of the exhaust valve 211, as shown in FIG. 5D. Further, after setting the hydraulic pressure ON of the connecting oil passage R13 of the second connecting member 29A, if the internal combustion engine 10 is stopped and supply of hydraulic pressure is stopped, as shown in FIG. 5B, the pin 28*b* is urged by the spring 28*a* to move forward to the hydraulic pressure 27*b*1, and the first connecting member 28A thereby becomes into a state of connecting the first vane rotor 26A and the second vane rotor 27A so that the pin 29*b* is urged by the spring 29*a* to move forward to the recessed portion 25*b*3. Thus, the second connecting member 29A becomes into a state of connecting the second vane rotor 27A and the wall surface portion 25*c*.

Incidentally, even not by the hydraulic pressure of the above-described delay angle oil passage R11, the first vane rotor 26A and the second vane rotor 27A in the housing 25A can rotate in the delay angle direction relative to the housing 25A and have the above-described attitude of the most delayed angle by the cam average torque. That is, in the most delayed angle control at the time when the internal combustion engine 10 is stopped and in the above-described delay angle control, it is also possible to rotate the first vane rotor 26A and the second vane rotor 27A in the delay angle direction, using not the hydraulic pressure but the cam average torque.

Open Angle Control After Most Advanced Angle Control

Figure 8A:
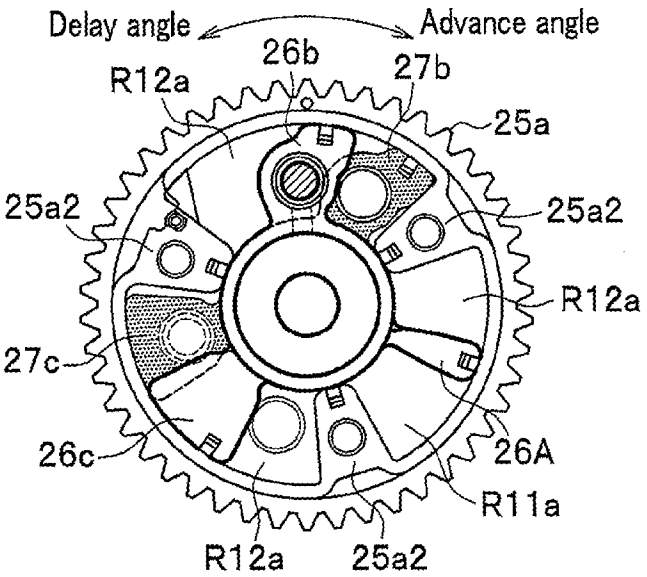
FIGS. 8A-8E are diagrams showing an example of controlling the valve gear in the first embodiment and showing a state that open angle control is performed after the most advanced angle control.
Figure 8B:
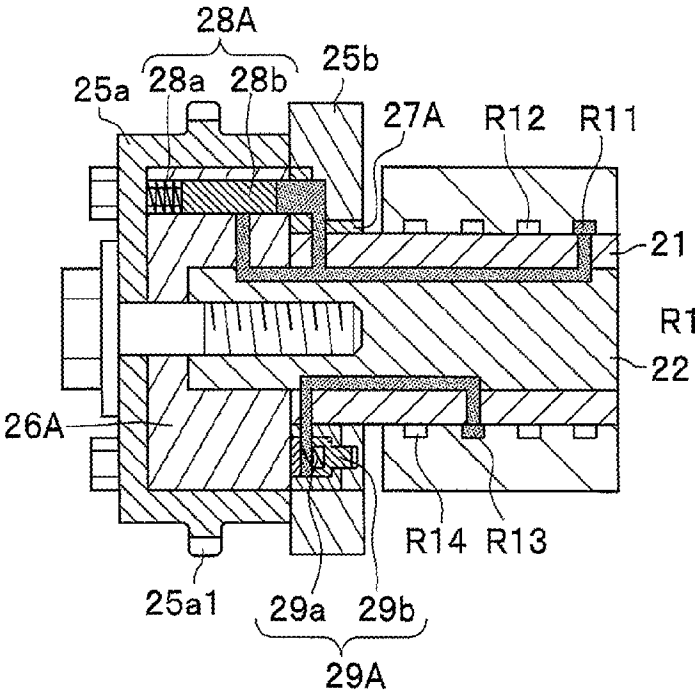
Figure 8C:
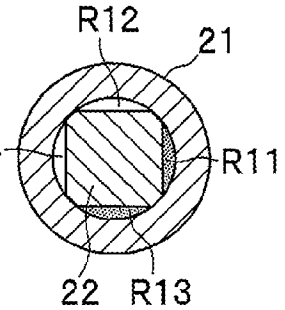
Figure 8D:
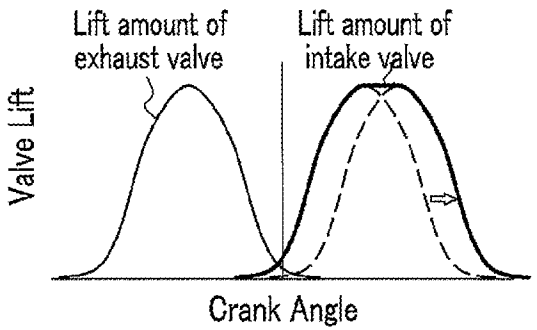

In the following, referring to FIGS. 8A-8E, open angle control after the most advanced angle control will be described. FIG. 8A is a diagram for illustration of the attitudes of the first vane rotor and the second vane rotor in open angle control after the most advanced angle control. FIG. 8B is a diagram for illustration of a state of the first connecting member and the second connecting member. FIG. 8C is a schematic diagram for illustration of the oil passages. FIG. 8D is a grapgh showing the relationship between the crank angle and the lift amount of a valve.

Figure 8E:
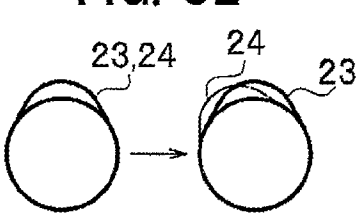

FIG. 8E is a diagram for illustration of the attitudes of the first cam piece and the second cam piece.

As shown in FIGS. 8A-8E, in case of performing open angle control of the first cam piece 23 and the second cam piece 24 after the most advanced angle control, from the state shown in FIGS. 6A-6E, by setting hydraulic pressure ON of the delay angle oil passage R11, hydraulic pressure OFF of the advance angle oil passage R12, hydraulic pressure ON of the connecting oil passage R13 of the second connecting member 29A, and hydraulic pressure OFF of the release oil passage R14 of the second connecting member 29A, the pin 29*b* is urged by the spring 29*a* to move forward to the recessed portion 25*b*4. Thus, the second connecting member 29A becomes into a state of connecting the second vane rotor 27A and the wall surface portion 25*b*, and the first connecting member 28A becomes into a state of having released the connection between the first vane rotor 26A and the second vane rotor 27A.

In such a state, by performing duty control of the hydraulic pressure of the delay angle oil passage R11, only the first vane rotor 26A is urged counterclockwise with respect to FIG. 8A by the hydraulic pressure of the delay angle oil chamber R11*a* to rotate; as shown in FIG. 8E, the second cam piece 24 moves to the delay angle side relative to the first cam piece 23; as shown in FIG. 8D, the valve close period of the intake valve 210 is delayed; and the valve open period thereby becomes longer.

Incidentally, in case of performing control to close an open angle, by setting hydraulic pressure OFF of the delay angle oil passage R11 and hydraulic pressure ON of the advance angle oil passage R12 and thereby performing duty control of the hydraulic pressure of the advance angle oil passage R12, only the first vane rotor 26A is urged to rotate clockwise with respect to FIG. 8A by the hydraulic pressure of the advance angle oil chamber R12*a*, and the second cam piece 24 moves relative to the first cam piece 23 to the advance angle side to bring forward the valve close period of the intake valve 210. Thus, the valve open period can be shortened.

Because the first vane rotor 26A and the second vane rotor 27A housed in the housing 25A function as phase control means, the valve system 1A provided with the valve gear 20A in the first embodiment of the invention can be downsized and is capable of changing the valve opening timing or the length of the valve open period of the intake valve 210.

Further, as the first vane rotor 26A and the second vane rotor 27A are lined up along the rotation axis O direction, the valve system 1A can change the phases of the first vane rotor 26A and the first connecting member second vane rotor 27A by a large amount.

Still further, being provided with the first connecting member 28A and the second connecting member 29A, the valve system 1A can integrally rotate the first vane rotor 26A and the second vane rotor 27A, rotate only the first vane rotor 26A, or independently rotate the first vane rotor 26A and the second vane rotor 27A.

Yet further, as the second vane rotor 27A is thinner than the first vane rotor 26A, the valve system 1A can be arranged to enable downsizing of the second vane rotor 27A along the rotation axis O direction and reducing the weight, and in addition, changing the phase of the second vane rotor 27A by the first vane rotor 26A.

Second Embodiment

Figure 9:
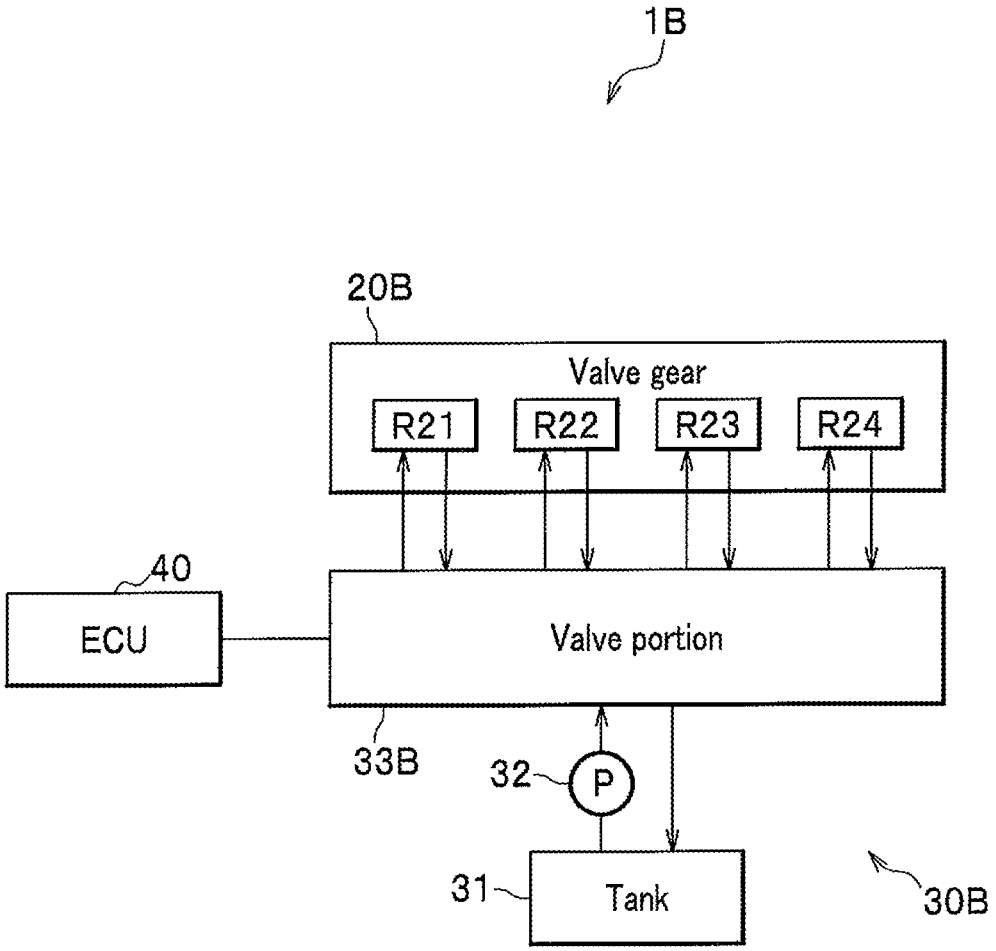
FIG. 9 is a schematic diagram showing a valve system in a second embodiment according to the invention.

In the following, a valve system in a second embodiment will be described, focusing on the difference from the valve system 1A in the first embodiment. As shown in FIG. 9, a valve system 1B in the second embodiment of the invention is provided with a valve gear 20B and a hydraulic pressure supply device 30B instead of the valve gear 20A and the hydraulic pressure supply device 30A.

Hydraulic Pressure Supply Device

The hydraulic pressure supply device 30B supplies hydraulic pressure to oil passages R21-R24 to drive a first vane rotor 26B, a second vane rotor 27B, a first connecting member 28B, and a second connecting member 29B (see FIG. 10) of the valve gear 20B. The hydraulic pressure supply device 30B includes a tank 31 for reserving oil, a pump 32 provided downstream of the tank 31 to generate hydraulic pressure in an oil circulation passage, and a valve portion 33B provided between the pump 32 and the oil passages R21-R24 to be able to switch between supplying and not supplying oil to the oil passages R11-R14. The tank 31, the pump 32, the valve portion 33B, and the oil passages R21-R24 structure the oil circulation passage.

Valve Gear

Figure 10:
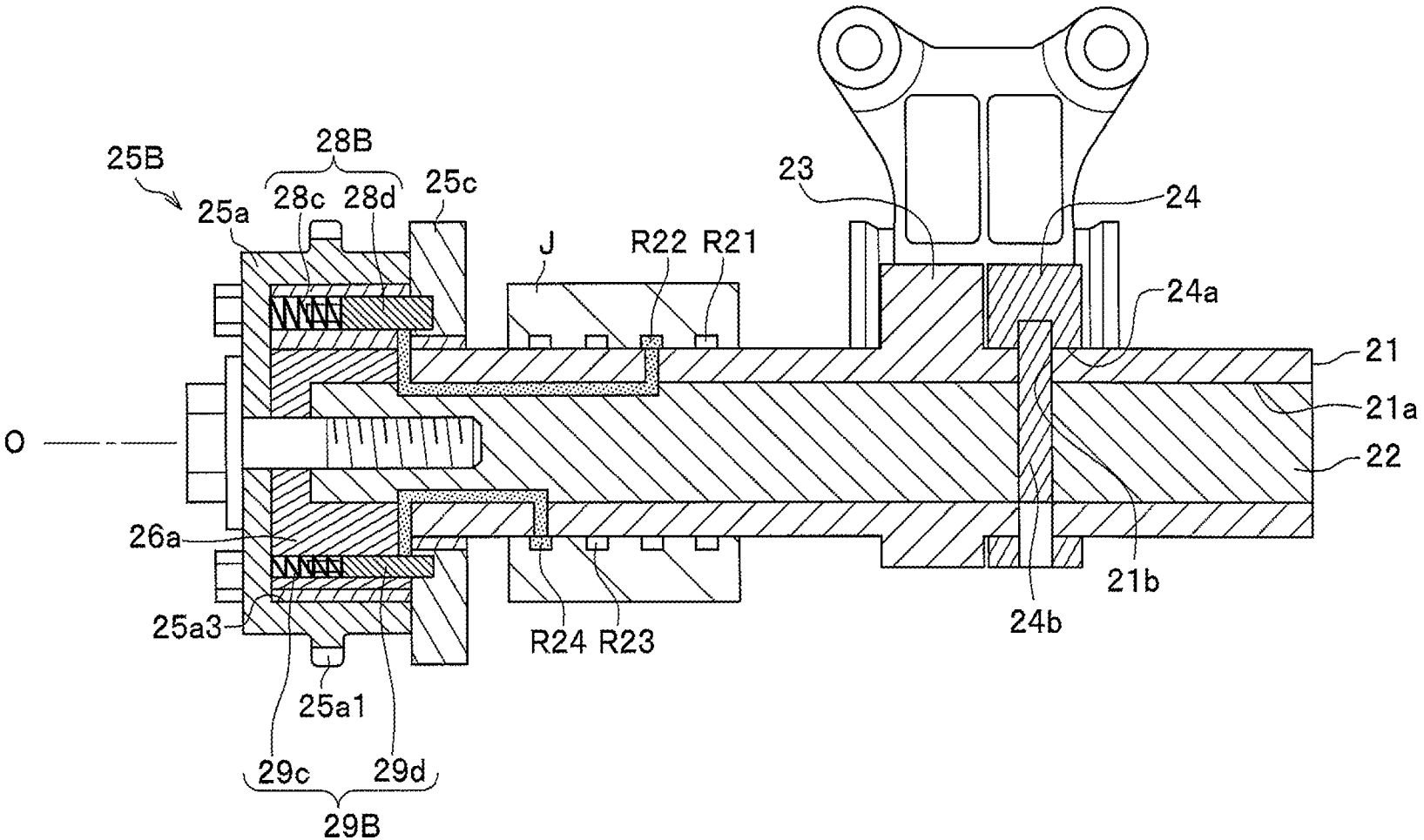
FIG. 10 is a cross-sectional view showing a valve gear in the second embodiment.

As shown in FIG. 10, the valve gear 20B is provided with a housing 25B, a first vane rotor 26B, a second vane rotor 27B, a first connecting member 28B, and a second connecting member 29B, instead of the housing 25A, the first vane rotor 26A, the second vane rotor 27A, the connecting member 28A, and the connecting member 29A in the first embodiment.

Housing

Figure 11A:
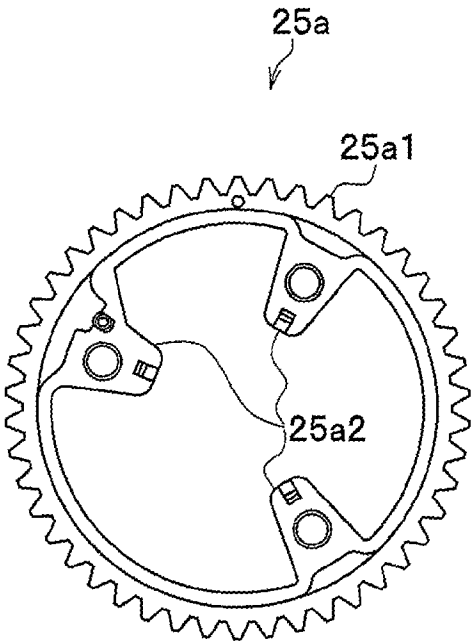
FIG. 11A to 11D are diagrams showing a hollow cylindrical portion, a wall surface portion, a first vane rotor, and a second vane rotor in the second embodiment, respectively.
Figure 11B:
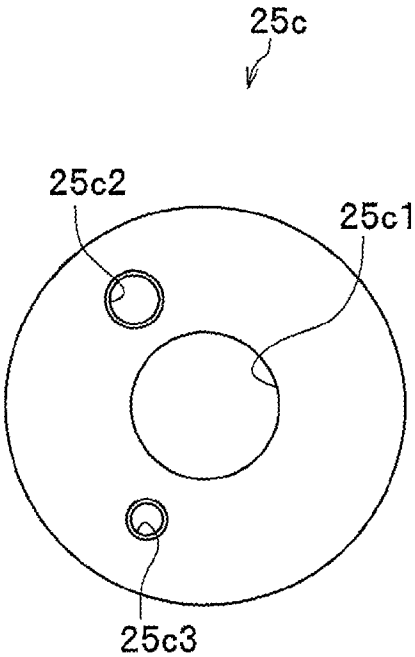
Figure 11C:
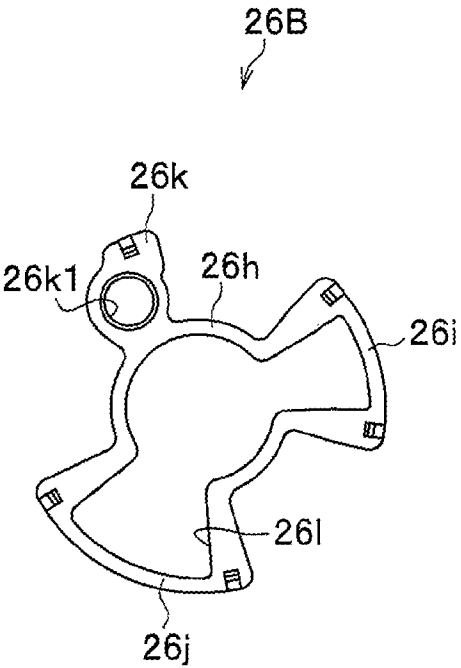

The housing 25B is provided with a wall surface portion 25*c*, shown in FIG. 11B, instead of the wall surface portion 25*b*. The wall surface portion 25*c* is a member in a disc shape having a diameter substantially the same as the diameter of the hollow cylindrical portion 25*a*, (see FIG. 11A). and is arranged such as to close the opening of the hollow cylindrical portion 25*a*. This wall surface portion 25*b* is provided with a central hole 25*c*1 through which the second cam shaft 22 and the hollow cylindrical portion 27*a* of the second vane rotor 27A are rotatably inserted. The inner surface of the wall surface portion 25*b* is provided with a recessed portion 25*c*2, into which a pin 28*d* of the first connecting member 28B can be inserted, and a recessed portion 25*c*3, into which the pin 29*d* of thr second connecting member 29B can be inserted. Herein, the recessed portion 25*c*2 is formed at a position corresponding to the most delayed angle position of the first vane rotor 26B, and the recessed portion 25*c*3 is provided at the most delayed angle position of the second vane rotor 27B, in other words, at the most advanced angle position of the protruding portions 27B taken when the first vane rotor 26B is located at the most delayed angle position.

First Vane Rotor

The first vane rotor 26B is rotatable relative to the housing 25B, and is connected to the first cam shaft 21, being prohibited to rotate relative to the first cam shaft 21.

The first vane rotor 26B is, as shown in FIG. 11, provided with a hollow cylindrical portion 26*h* connected to the first cam shaft 21 and three protruding portions 26*i*, 26*j*, and 26*k* protruding outward in the radial direction from the hollow cylindrical portion 26*h*. The protruding portions 26*i*-26*k* protrude outward in the radial direction from the hollow cylindrical portion 26*h*, and are disposed between the facing stoppers 25*a*2. The protruding portions 26*i*-26*k* are formed in a fan shape, wherein the protruding portion 26*k* is provided with a recessed portion 26*k*1 in which the first connecting member 28B is arranged. Further, the hollow cylindrical portion 26*h* and the protruding portions 26*i*, 26*j* are provided with a closed space 261 in which the second vane rotor 27B is housed.

Second Vane Rotor

The second vane rotor 27B is rotatable relative to the housing 25B and the first vane rotor 26B, and is connected with the second cam shaft 22, being prohibited to rotate relatively to it.

Figure 11D:
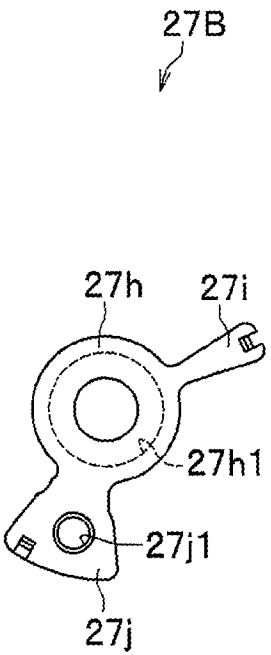

The second vane rotor 27B is, as shown in FIG. 11D, provided with a hollow cylindrical portion 27*h*, and two protruding portions 27*i*, 27*j* protruding outward in the radial direction from the hollow cylindrical portion 27*h*. The hollow cylindrical portion 27*h* is housed in the hollow cylindrical portion 26*h* of the closed space 261, the protruding portion 27*i* is housed in the protruding portion 26*i* of the closed space 261, and the protruding portion 27*j* is housed in the protruding portion 26*j* of the closed space 261. The protruding portion 27*j* is formed in a fan shape, and is provided with a recessed portion 27*j*1 in which the second connecting member 29B is arranged.

In the present embodiment, the thickness of the first vane rotor 26B (in more details, the protruding portions 26*i*, 26*j*, and 26*k*) in the rotation axis O direction is equal to the thickness of the second vane rotor 27B (in mode details, the protruding portions 27*i*, 27*j*) in the rotation axis O direction, and are set equal to the depth of the housing portion 25*a*3 of the hollow cylindrical portion 25*a*. That is, the first vane rotor 26B and the second vane rotor 27B are formed fully along the axial direction in the housing 25B, having respective sufficient pressure receiving areas to be able to independently rotate by hydraulic pressure.

Oil Passages

Among the above-described oil passages R21-R24, the oil passage R21 is a delay angle passage for rotating the first vane rotor 26B in the delay angle direction, and the oil passage R22 is an advance angle oil passage for rotating the first vane rotor 26B in the advance angle direction. The oil passage R23 is a delay angle oil passage for rotating the second vane rotor 27B in the delay angle direction, and the oil passage R24 is an advance angle passage for rotating the second vane rotor 27B in the advance angle direction. Delay angle oil chambers R21a are provided respectively on the delay angle oil passage R21, between the protruding portion 26*i* and the advance angle side surface of the corresponding stopper 25*a*2, between the protruding portion 26*j* and the advance angle side surface of the corresponding stopper 25*a*2, and between the protruding portion 26*k* and the advance angle side surface of the corresponding stopper 25*a*2. Advance angle oil chambers R22*a* are provided respectively on the advance angle oil passage R22, between the protruding portion 26*i* and the delay angle side surface of the corresponding stopper 25*a*2, between the protruding portion 26*jc* and the delay angle side surface of the corresponding stopper 25*a*2, and between the protruding portion 26*k* and the delay angle side surface of the corresponding stopper 25*a*2. Delay angle oil chambers R23*a* are respectively provided on the delay angle oil passage R23, between the protruding portion 27*i* and the advance angle side surface of the protruding portion 26*i*, and between the protruding portion 27*j* and the advance angle side surface of the protruding portion 26*j*. Advance angle oil chambers R24*a* are provided respectively on the advance angle oil passage R24, between the protruding portion 27*i* and the delay angle side surface of the corresponding protruding portion 26*i*, between the protruding portion 27*j* and the delay angle side surface of the protruding portion 26*j*. Incidentally, the advance angle oil passage R22 also serves as a release oil passage for releasing the connection by the first connecting member 28B, and the advance angle oil passage R24 also serves as a release oil passage for releasing the connection by the second connecting member 29B.

First Connecting Member

As shown in FIG. 10, the first connecting member 28B is a member capable of connecting the wall surface portion 25*c* and the first vane rotor 26B, and is provided with a spring 28*c* housed in the bottom side of the recessed portion 26*k*1, and a pin 28*d* housed on the opening side of the recessed portion 26*k*1 and urged toward the wall surface portion 25*c* by the spring 28*c*.

This pin 28*d* moves forward toward the wall surface portion 25*c* and backward, wherein the length of the forward and backward movement is substantially equal to or shorter than the axial direction length of the recessed portion 25*c*2 of the wall surface portion 25*c*. When the position of the pin 28*d* agrees with the position of the recessed portion 25*c*2 and hydraulic pressure is not supplied to the advance angle oil passage R22, the pin 28*d* moves forward by the urging force of the spring 28*c* to be inserted into the recessed portion 25*c*2 of the wall surface portion 25*c* so that the first connecting member 28B prohibits relative rotation between the first vane rotor 26B and the wall surface portion 25*c*. When hydraulic pressure is supplied to the advance angle oil passage R22, the space between the tip end of the pin 28*d* and the recessed portion 25*c*2 is filled with oil and the pin 28*d* moves backward by the hydraulic pressure against the urging force of the spring 28*c* to move out from the recessed portion 25*c*2 of the wall surface portion 25*c*, thereby the first connecting member 28B permitting relative rotation between the first vane rotor 26B and the wall surface portion 25*c*. When the first vane rotor 26B rotates relative to the wall surface portion 25*c*, the tip end of the pin 28*d* slides on the inner surface of the wall surface portion 25*c*.

Second Connecting Member

The second connecting member 29B is a member capable of connecting the wall surface portion 25*c* and the second vane rotor 27B, and is provided with a spring 29*c* housed on the bottom side of the recessed portion 27*j*1, and a pin 29*d* housed in the opening side of the recessed portion 27*j*1 and urged toward the wall surface portion 25*c* by the spring 29*c*.

This pin 29*d* moves forward toward the wall surface portion 25*c* and backward, wherein the length of the forward and backward movement is substantially equal to or shorter than the axial direction length of the recessed portion 25*c*3 of the wall surface portion 25*c*. When the position of the pin 29*d* agrees with the position of the recessed portion 25*c*3 and hydraulic pressure is not supplied to the advance angle oil passage R24, the pin 29*d* moves forward by the urging force of the spring 29*c* to be inserted into the recessed portion 25*c*3 of the wall surface portion 25*c* so that the second connecting member 29B prohibits relative rotation between the second vane rotor 27B and the wall surface portion 25*c*. When hydraulic pressure is supplied to the advance angle oil passage R24, the space between the tip end of the pin 29*d* and the recessed portion 25*c*3 is filled with oil, and the pin 29*d* moves backward by the hydraulic pressure against the urging force of the spring 29*c* to move out from the recessed portion 25*c*3 of the wall surface portion 25*c*, thereby the second connecting member 29B permitting relative rotation between the second vane rotor 27B and the wall surface portion 25*c*. When the second vane rotor 27B rotates relative to the wall surface portion 25*c*, the tip end of the pin 29*d* slides on the inner surface of the wall surface portion 25*c*.

Example of Control

In the following, an example of control by the ECU 40 of the valve gear 20B in the second embodiment of the invention will be described in the order of the most delayed angle control at the time when the internal combustion engine 10 is stopped, advance angle control after the internal combustion engine 10 starts, delay angle control, and open angle control after the most advanced angle control.

Incidentally, a valve system 1B is provided with known cam angle sensors for detecting the rotation angles (attitudes) of respective camshafts 21, 22, wherein the ECU 40 performs feedback control of the hydraulic pressures of the delay angle oil passages R21-24 so that real rotation angles detected by the cam angle sensors agree with respective target angles of the camshafts 21, 22.

Control During at Time when Internal Combustion Engine is Stopped

Figure 12A:
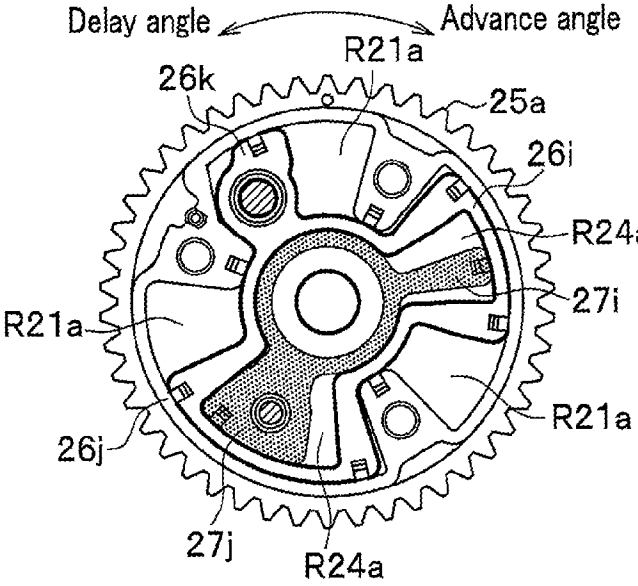
FIGS. 12A-12E are diagrams showing an example of controlling the valve gear in the second embodiment and showing a state at the time when an internal combustion engine is stopped.
Figure 12B:
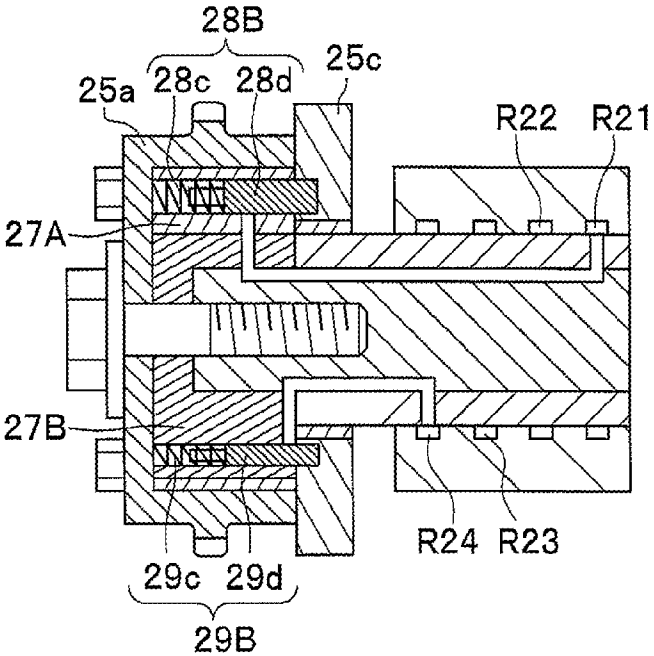
Figure 12C:
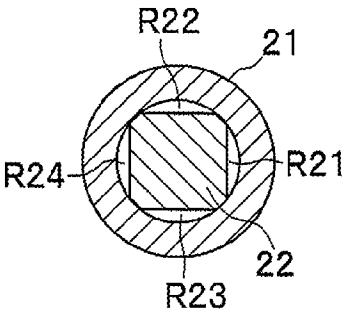
Figure 12D:
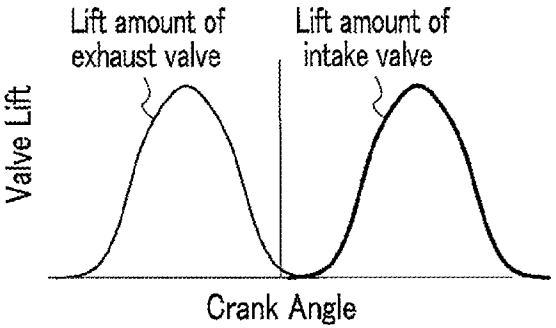
Figure 12E:
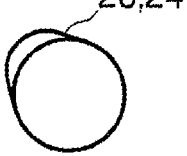

First, a state at the time when the internal combustion engine 10 is stopped will be described, referring to FIGS. 12A-12E. FIG. 12A is a diagram for illustration of the attitudes of the first van rotor and the second vane rotor at the time when the internal combustion engine is stopped. FIG. 12B is a diagram for illustration of the state of the first connecting member and the second connecting member. FIG. 12C is a schematic diagram for illustration of oil passages. FIG. 12D is a graph representing the relationship between the crank angle and the lift amount of a valve. FIG. 12E is a diagram for illustration of the attitudes of the first cam piece and the second cam piece.

As shown in FIGS. 12A-12E, at the time when the internal combustion engine 10 is stopped, the first vane rotor 26B and the second vane rotor 27B are located at the most delayed angle positions. That is, the delay angle side surfaces of the protruding portions 26*i*, 26*j*, and the 26*k* of the first vane rotor 26B contact the advance angle side surfaces of the stoppers 25*a*2, and the advance angle side surfaces of the protruding portions 27*i* and 27*j* of the second vane rotor 27B contact the delay angle side surfaces inside the protruding portions 26*i*, 26*j*.

As the internal combustion engine 10 is stopped and supply of hydraulic pressure is stopped, the pin 28*d* is urged by the spring 28*c* to move forward to the recessed portion 25*c*2. Thus, the first connecting member 28B becomes into a state of connecting the first vane rotor 26B and the wall surface portion 25*c*. Likewise, the pin 29*d* is urged by the spring 29*c* to move forward to the recessed portion 25*c*3. Thus, the second connecting member 29B becomes into a state of connecting the second vane rotor 27B and the wall surface portion 25*c*.

In this state, as shown in FIG. 12E, the first cam piece 23 and the second cam piece 24 have integrally moved to the most delayed angle side, and as shown FIG. 12D, the valve open period of the intake valve 210 does not overlap with the valve open period of the exhaust valve 211.

Advance Angle Control After Internal Combustion Engine Starts

Figure 13A:
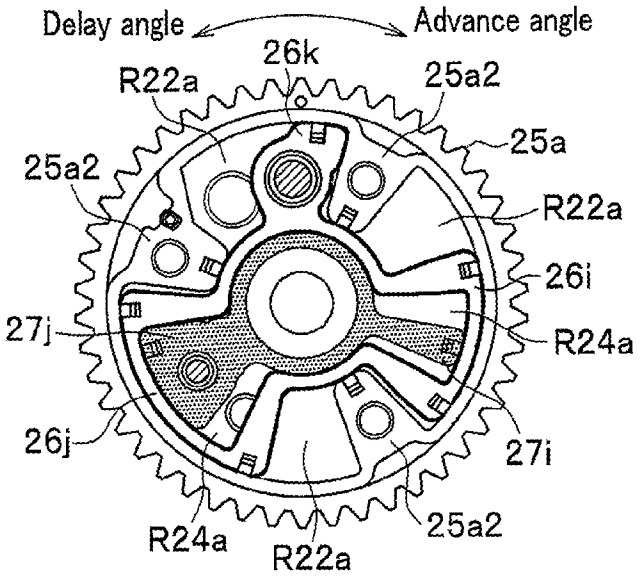
FIGS. 13A-13E are diagrams showing an example of controlling the valve gear in the second embodiment and showing a state that advance angle control is performed after a startup of the internal combustion engine.
Figure 13B:
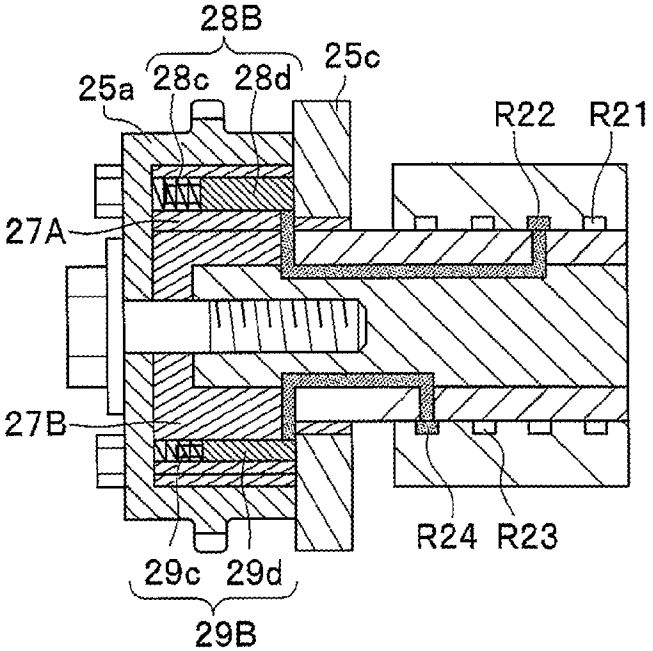
Figure 13C:
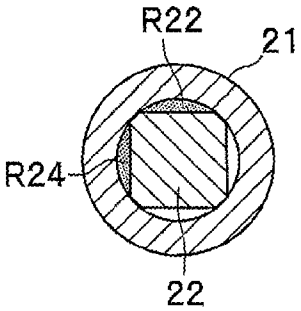
Figure 13D:
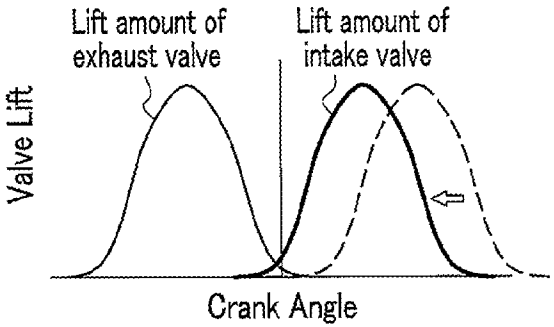
Figure 13E:
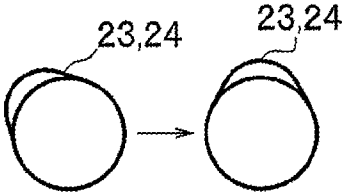

In the following, advance angle control after the internal combustion engine 10 starts will be described, referring to FIGS. 13A-13E. FIG. 13A is a diagram for illustration of the attitudes of the first vane rotor and the second vane rotor during advance angle control after the internal combustion engine starts. FIG. 13B is a diagram for illustration of the state of the first connecting member and the second connecting member. FIG. 13C is a schematic diagram for illustration of the oil passages. FIG. 13D is a graph representing the relationship between the crank angle and the lift amount of a valve. FIG. 13E is a diagram for illustration of the attitudes of the first cam piece and the second cam piece. Incidentally, FIGS. 13A-13E are diagrams showing a case of the most advanced angle control in which rotation to the most advanced angle direction out of advance angle control is made.

Subsequent to a start of the internal combustion engine 10, in performing advance angle control as shown in FIGS. 13A-13E of the first cam piece 23 and the second cam piece 24, switching is performed from the state shown in FIGS. 12A-12E to a state of hydraulic pressure OFF of the delay angle oil passage R21, hydraulic pressure ON of the advance angle oil passage R22, hydraulic pressure ON of the delay angle oil passage R23, and hydraulic pressure ON of the advance angle oil passage R24. Thus, the pin 28*d* moves backward out from the hole portion 25*c*2 by hydraulic pressure, and the first connecting member 28B thus becomes into a state of releasing the connection between the first vane rotor 26B and the wall surface portion 25*c*. Likewise, the pin 29*d* moves backward out from the hole portion 25*c*3 by hydraulic pressure, and the second connecting member 29B thus becomes into a state of releasing the connection between the second vane rotor 27B and the wall surface portion 25*c*. Herein, the first vane rotor 26B is urged and rotated clockwise with respect to FIG. 13A, namely in the advance angle direction, by hydraulic pressure of the advance angle oil chamber R22*a*. The advance angle amount (angle of advance angle) of the first vane rotor 26B can be made a desired advance angle amount by duty control of the hydraulic pressure of the advance angle oil passage R22.

Delay Angle Control

Figure 14A:
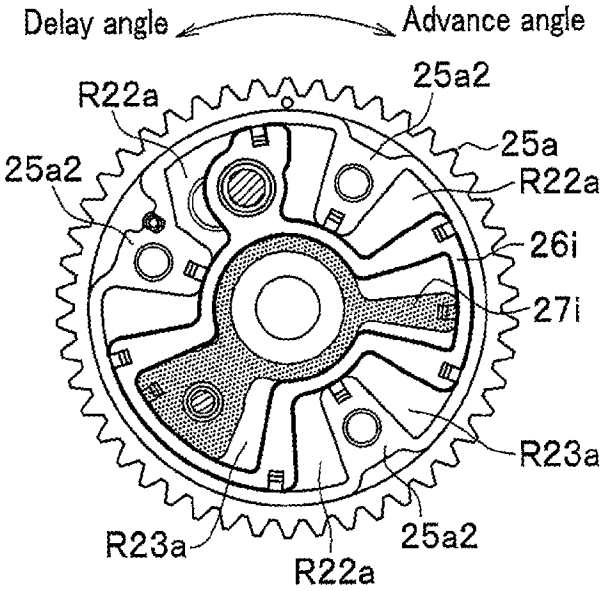
FIGS. 14A-14E are diagrams showing an example of controlling the valve gear in the second embodiment and showing a state that delay angle control is performed.
Figure 14B:
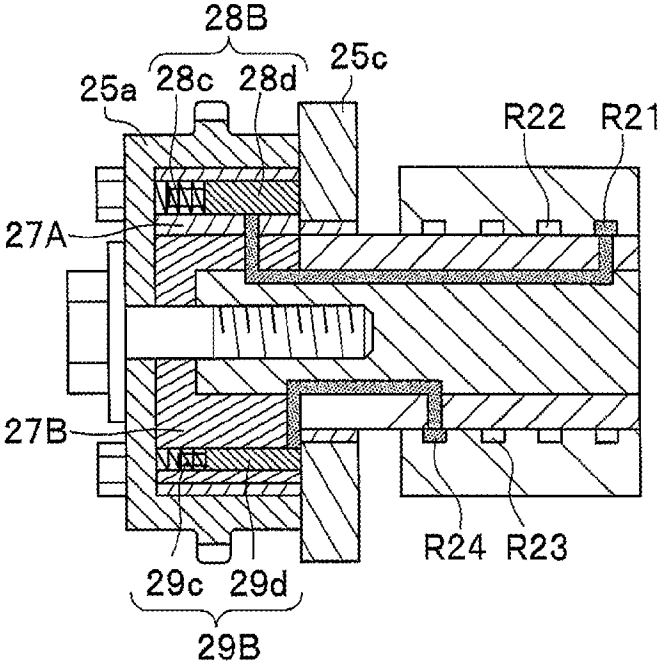
Figure 14C:
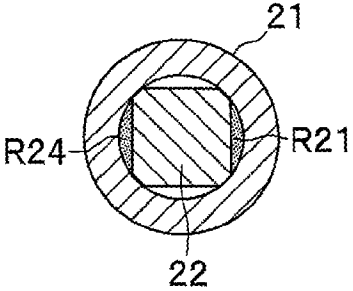

Delay angle control will be described below, referring to FIGS. 14A-14E. FIG. 14A is a diagram for illustration of the attitudes of the first vane rotor and the second vane rotor during delay angle control. FIG. 14B is a diagram for illustration of the state of the first connecting member and the second connecting member. FIG. 14C is a schematic diagram for illustration of the oil passages.

Figure 14D:
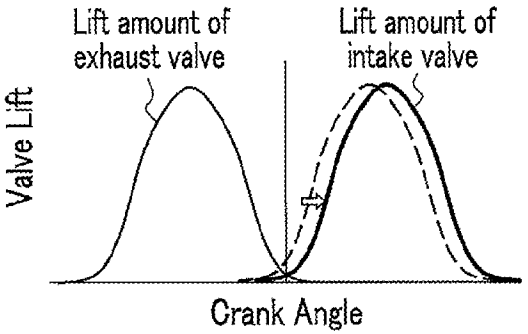
Figure 14E:
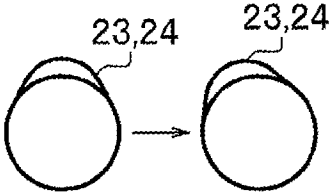

FIG. 14D is a graph representing the relationship between the crank angle and the lift amount of a valve. FIG. 14E is a diagram for illustration of the attitudes of the first cam piece and the second cam piece.

Subsequent to advance angle control, in performing delay angle control, as shown in FIGS. 14A-14E, of the first cam piece 23 and the second cam piece 24, switching is performed from the state, for example shown in FIGS. 13A-13E, to a state of hydraulic pressure ON of the delay angle oil passage R21, hydraulic pressure OFF of the advance angle oil passage R22, hydraulic pressure OFF of the delay angle oil passage R23, and hydraulic pressure ON of the advance angle oil passage R24. Thus, the first vane rotor 26B is urged and rotated counterclockwise with respect to FIG. 14A, namely in the delay angle direction, by hydraulic pressure of the delay angle oil passage 21*a*. The delay angle amount (angle of delay angle) of the first vane rotor 26B can be made a desired delay angle amount by duty control of the hydraulic pressure of the delay angle oil passage R21. That is, after the start of the internal combustion engine 10, the valve gear 20B can make the integral attitude of the first cam piece 23 and the second cam piece 24 be a desired attitude between the most delayed angle and the most advanced angle by advance angle control and delay angle control.

Most Delayed Angle Control

As an example of delay angle control, in performing the most delayed angle control of the first cam piece 23 and the second cam piece 24 immediately before the internal combustion engine 10 stops, hydraulic pressure is set immediately before the internal combustion engine 10 stops such as ON for the delay angle oil passage R21, OFF for the advance angle oil passage R22, OFF for the delay angle oil passage R23, and ON for the advance angle oil passage R24. Thus, the first vane rotor 26B is urged and rotated in counterclockwise direction with respect to FIG. 14A, namely the delay angle direction, by the hydraulic pressure of the delay angle oil chamber R21*a*, and the delay angle side surfaces of the protruding portions 26*i*, 26*j*, and 26*k* contact the advance angle side surfaces of the stoppers 25*a*2. The second vane rotor 27B is urged and rotated in the advance angle direction by the hydraulic pressure of the advance angle oil chamber R24*a*, and the advance angle side surfaces of the protruding portions 27*i*, 27*j* contact the delay angle side surfaces in the protruding portions 26*i*, 26*j*. In this state, the pin 28*d* moves forward to the recessed portion 25*c*2, and the first connecting member 28B becomes into a state of connecting the first vane rotor 26B and the wall surface portion 25*c*.

In this state, as shown in FIG. 12E, the first cam piece 23 and the second cam piece 24 have integrally moved to the delay angle side, and as shown in FIG. 12D, the valve open period of the intake valve 210 and the valve open period of the exhaust valve 211 do not overlap with each other. Further, when the internal combustion engine 10 is stopped and supply of hydraulic pressure is stopped, as shown in FIGS. 12A-12E, hydraulic pressure in the release oil passage for the second connecting member 29B is lost, the pin 29*d* moves forward to the recessed portion 25*c*3, and the second connecting member 29B thereby becomes into a state of connecting the second vane rotor 27B and the wall surface portion 25*c*.

Incidentally, even not by the hydraulic pressure of the above-described delay angle oil passage R21, the first vane rotor 26B in the housing 25A rotates in the delay angle direction relative to the housing 25B by the cam average torque to be able to have the above-described attitude of the most delayed angle. That is, in the most delayed angle control at the time when the internal combustion engine 10 is stopped and the above-described delay angle control, the first vane rotor 26B can also be rotated in the delay angle direction, by the use of the cam average torque instead of hydraulic pressure.

Open Angle Control After Most Advanced Angle Control

Figure 15A:
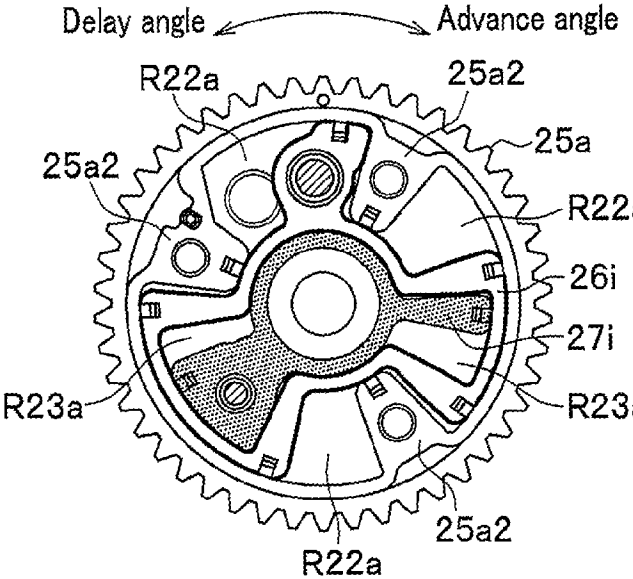
FIGS. 15A-15E are diagrams showing an example of controlling the valve gear in the second embodiment and showing a state that open angle control is performed after the most advanced angle control.
Figure 15B:
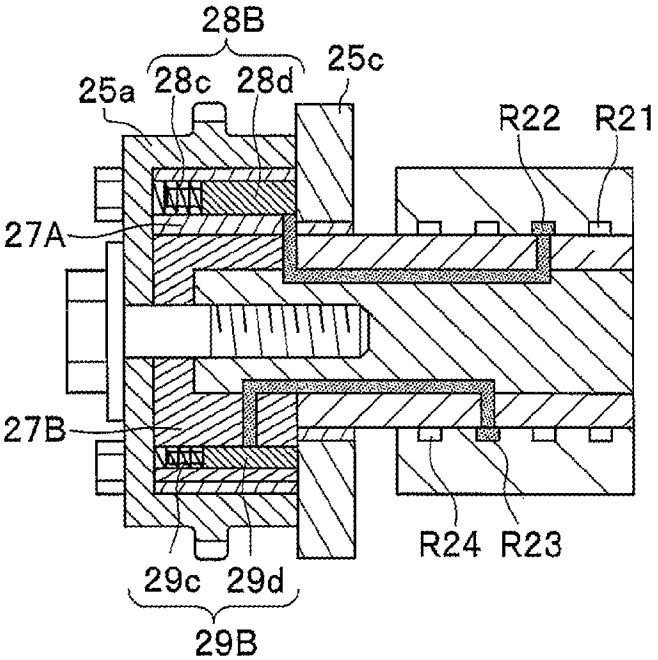
Figure 15C:
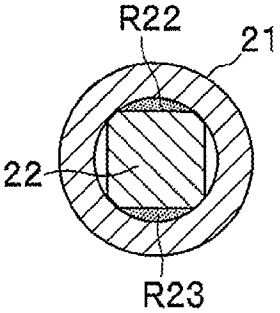
Figure 15D:
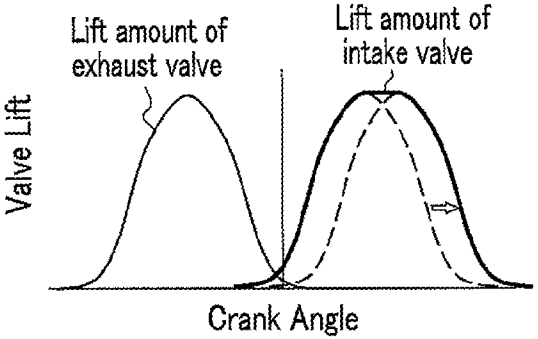
Figure 15E:
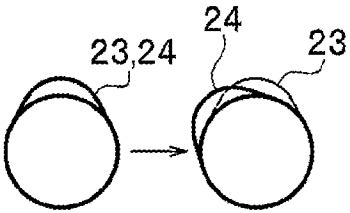

In the following, referring to FIGS. 15A-15E, open angle control after the most advanced angle control will be described. FIG. 15A is a diagram for illustration of the attitudes of the first vane rotor and the second vane rotor in open angle control. FIG. 15B is a diagram for illustration of the state of the first connecting member and the second connecting member. FIG. 15C is a schematic diagram for illustration of the oil passages. FIG. 15D is a graph representing the relationship between the crank angle and the lift amount of a valve. FIG. 15E is a diagram for illustration of the attitudes of the first cam piece and the second cam piece.

As shown in FIGS. 15A-15E, in performing open angle control of the first cam piece 23 and the second cam piece 24 after the most advanced angle control, switching is performed from the state in FIGS. 13A-13E to a state of hydraulic pressure OFF for the delay angle oil passage R21, ON for the advance angle oil passage R22, ON for the delay angle oil passage R23, and OFF for the advance angle oil passage R24. Thus, the second vane rotor 27B is urged and rotated in the counterclockwise direction with respect to FIG. 15A, namely the delay angle direction by the hydraulic pressure of the delay angle oil chamber R23*a*.

In this state, by performing duty control of the hydraulic pressure of the delay angle oil passage R23, only the second vane rotor 27B is urged and rotated counterclockwise with respect to FIG. 15A by the hydraulic pressure of the delay angle oil chamber R23*a*; as shown in FIG. 15E, the second cam piece 24 moves to the delay angle side relative to the first cam piece 23; and as shown in FIG. 15D, the valve close timing of the intake valve 210 is delayed so that the valve open period becomes longer.

Incidentally, in performing control to close an open angle, by making the hydraulic pressure of the delay angle oil passage R23 OFF and the hydraulic pressure of the advance angle oil passage R24 ON to thereby perform duty control of the hydraulic pressure of the advance angle oil passage R24, only the second vane rotor 27B is urged and rotated clockwise with respect to FIG. 15A by the hydraulic pressure of the advance angle oil chamber R24*a*, and the second cam piece 24 moves to the advance angle side relative to the first cam piece 23. Thus, the valve close timing of the intake valve 210 is brought forward, and the valve open period can thereby be made shorter.

The valve system 1B provided with the valve gear 20B in the second embodiment of the invention is arranged such that the second vane rotor 27B is provided on the radially inner side of the first vane rotor 26B, and it is thereby possible to make the both vane rotors have respective pressure receiving sufficient areas and thus make the first vane rotor 26B and the second vane rotor 27B rotate respectively alone.

Further, as the valve system 1B is provided with the first connecting member 28B and the second connecting member 29B, it is possible to rotate only one of the first vane rotor 26B and the second vane rotor 27B, and rotate the first vane rotor 26B and the second vane rotor 27B independently from each other.

Embodiment of the present invention have been described above, however, the invention is not limited to the foregoing embodiments, and modifications and changes can be made, as appropriate, without departing from the spirit of the invention. For example, as the relative relationship of the opening and closing timing between the intake valve 210 and the exhaust valve 211 can be changed, a valve gear according to the invention may be one that changes the phase (opening and closing timing) of the exhaust valve 211 instead of the intake valve 210, or may be one that changes the respective valve opening timings and the lengths of the respective valve open periods of the intake valve 210 and the exhaust valve 211. Further, the numbers of vane rotors, camshafts, and cam pieces may be set to three or more. Further, in case that the valve gear is one that drives the exhaust valve 211, the first vane rotor and the second vane rotor are located at the most advanced angle when the internal combustion engine 10 is stopped and is started. Still further, by changing the locations and numbers of the recessed portions 25*b*1-25*b*4, setting of phases and setting of the number of phases of the first vane rotor and the second vane rotor can be changed. Yet further, the structures of the first connecting member 28A and the second connecting member 29A are not limited to the above-described structures. Further, the number of protruding portions of the first vane rotors 26A, 26B, and the second vane rotors 27A, 27B can be changed, as appropriate. Still further, instead of the first connecting member 29B or the second connecting member 29B, a connecting member capable of connecting or releasing connection of the first vane rotor 26B and the second vane rotor 27B may be included.

Further, in the first embodiment, the release oil passage for the first connecting member 28A may be provided separately from the delay angle oil passage R11.

Incidentally, in case of applying a valve gear according to the invention to the exhaust valve 211 side, the first vane rotor and the second vane rotor are rotated to the most delayed angle position by the cam average torque at the time when the internal combustion engine 10 is stopped. Herein, the valve gear applied to the exhaust valve 211 side sets the most advanced angle position at a start of the internal combustion engine 10, and thereafter performs delay angle control, advance angle control, and open angle control after the most delayed angle control. In such a manner, as it is necessary to set the most advanced angle position at a time when the internal combustion engine 10 is stopped, in case of applying a valve gear according to the invention to the exhaust valve 211 side, an assist spring for urging the first cam shaft 21 in the advance angle direction relative to the housings 25A, 25B is provided, and a torque is thereby made act for relative rotation of the first cam shaft 21 and the second cam shaft 22 in the advance angle direction against the above-described cam average torque.

DESCRIPTION OF REFERENCE SYMBOLS

1A, 1B . . . valve system
20A, 20B . . . valve gear
21 . . . first cam shaft
22 . . . second cam shaft
23 . . . first cam piece
24 . . . second cam piece

25A, 25B . . . housing
26A, 26B . . . first vane rotor
27A, 27B . . . second vane rotor
28A, 29A . . . connecting member
28B . . . first connecting member
29B . . . second connecting member

The invention claimed is:

1. A valve gear driving an engine valve of an internal combustion engine, comprising:

a first camshaft rotatable around a rotation axis;

a first cam piece driving the engine valve, the first cam piece being prohibited to rotate relative to the first camshaft;

a second camshaft disposed inside the first camshaft, the second camshaft being rotatable around the rotation axis;

a second cam piece driving the engine valve, the second cam piece being prohibited to rotate relative to the second camshaft;

a housing;

a first vane rotor housed in the housing, the first vane rotor being rotatable relative to the housing; and a second vane rotor housed in the housing, the second vane rotor being rotatable relative to the housing and the first vane rotor, wherein the first vane rotor is connected to one of the first camshaft and the second camshaft, being prohibited to rotate relative to the one, and wherein the second vane rotor is connected to the other one of the first camshaft and the second camshaft, being rotatable relative to the other one, the valve gear, further comprising:

a first connecting member switching between a permission state and a prohibition state, wherein relative rotation between the first vane rotor and the second vane rotor or relative rotation between the housing and one of the first vane rotor and the second vane rotor is permitted in the permission state; and prohibited in the prohibition state, and a second connecting member switching between a permission state and a prohibition state, wherein relative rotation between the housing and the other one of the first vane rotor and the second vane rotor is permitted in the permission state and prohibited in the prohibition state.

2. The valve gear according to claim 1, wherein the first vane rotor and the second vane rotor are lined up along the rotation axis direction.

3. The valve gear according to claim 2, wherein the first connecting member is switching between a permission state and a prohibition state, wherein relative rotation between the first vane rotor and the second vane rotor is permitted in the permission state and prohibited in the prohibition state; and the second connecting member is switching between a permission state and a prohibition state, wherein relative rotation between the housing and the second vane rotor is permitted in the permission state and prohibited in the prohibition state.

4. The valve gear according to claim 3, wherein the first connecting member includes:

a first spring housed in the first vane rotor; and a first pin housed in the first vane rotor and entering the second connecting member by an urging force of the first spring, and wherein the second connecting member includes:

a second spring housed in the second vane rotor; and a second pin housed in the second vane rotor and entering the housing by an urging force of the second spring.

5. The valve gear according to claim 1, wherein the second vane rotor is arranged on a radially inner side of the first vane rotor.

6. The valve gear according to claim 5, wherein the first connecting member is switching between a permission state and a prohibition state, wherein the permission state permits and the prohibition state prohibits relative rotation between the first vane rotor and the housing; and the second connecting member is switching between a permission state and a prohibition state, wherein the permission state permits and the prohibition state prohibits relative rotation between the housing and the second vane rotor.

7. The valve gear according to claim 6, wherein the first connecting member includes:

a first spring housed in the first vane rotor; and a first pin housed in the first vane rotor and entering the housing by an urging force of the first spring, and wherein the second connecting member includes:

a second spring housed in the second vane rotor; and a second pin housed in the second vane rotor and entering the housing by an urging force of the second spring.

8. The valve gear according to claim 1, wherein the first cam piece and the second cam piece drive the same engine valve.

* * * * *